US010517416B1

(12) United States Patent
Petren

(10) Patent No.: US 10,517,416 B1
(45) Date of Patent: Dec. 31, 2019

(54) ACCESSABILITY ENABLING OVER-THE-DOOR RACK

(71) Applicant: Alaina Petren, Clinton Corners, NY (US)

(72) Inventor: Alaina Petren, Clinton Corners, NY (US)

( * ) Notice: Subject to any disclaimer, the term of this patent is extended or adjusted under 35 U.S.C. 154(b) by 0 days.

(21) Appl. No.: 16/043,531

(22) Filed: Jul. 24, 2018

(51) Int. Cl.

| | |
|---|---|
| ***A47G 25/06*** | (2006.01) |
| ***A47B 96/16*** | (2006.01) |
| ***A47B 45/00*** | (2006.01) |
| ***A47B 43/00*** | (2006.01) |

(52) U.S. Cl.
CPC ..... *A47G 25/0614* (2013.01); *A47B 43/006* (2013.01); *A47B 45/00* (2013.01); *A47B 96/16* (2013.01); *A47G 25/0685* (2013.01)

(58) Field of Classification Search
CPC ..... A47G 25/0614; A47G 25/0685; A47G 25/06; A47G 25/0607; A47G 25/0628; A47G 25/0642; A47G 25/065; A47G 25/746; A47B 96/16; A47B 45/00; A47B 96/025; A47B 43/003; A47B 43/006; A47B 43/04; A47B 43/00; A47B 61/003; A47F 7/143; A47F 5/10; D06F 57/12
USPC .... 211/19.004, 90.02, 90.04, 104, 96, 181.1, 211/119.009, 150, 175, 117, 90.03, 211/119.004; 312/3–6; 108/42–47
See application file for complete search history.

(56) References Cited

U.S. PATENT DOCUMENTS

| | | | | | |
|---|---|---|---|---|---|
| 971,493 | A * | 9/1910 | Crane | A47G 25/0685 | 211/99 |
| 1,189,677 | A | 7/1916 | Farlese | | |
| 2,090,108 | A * | 8/1937 | Cicero | A47B 61/02 | 211/104 |
| 2,270,796 | A | 1/1942 | Hauser | | |
| 2,508,527 | A | 5/1950 | Martin | | |
| 2,626,714 | A * | 1/1953 | Rover | A47G 25/08 | 211/100 |
| 2,633,998 | A * | 4/1953 | Derman | A47G 25/08 | 108/135 |
| 2,637,446 | A * | 5/1953 | Spangler | A47K 10/10 | 211/105.5 |
| 2,675,130 | A * | 4/1954 | Dore | A47G 25/18 | 211/118 |
| 2,925,916 | A | 2/1960 | Pollock | | |
| 2,972,419 | A * | 2/1961 | Eli | A47G 25/16 | 211/113 |
| 2,981,418 | A * | 4/1961 | Harold | D06F 57/122 | |
| 3,118,545 | A * | 1/1964 | Rosner | C25D 17/08 | 204/297.09 |
| 3,139,045 | A * | 6/1964 | Rojakovick | A47B 43/003 | 108/109 |

(Continued)

*Primary Examiner* — Jennifer E. Novosad
(74) *Attorney, Agent, or Firm* — Schmeiser, Olsen & Watts, LLP

(57) ABSTRACT

An over-the-door rack comprises a first suspension hook, a second suspension hook, a first vertical member, a second vertical member, a first hanging member, and a second hanging member. The first hanging member has a plurality of double hooks. The second hanging member has a plurality of hooks. The over-the-door rack is configured to be affixed to the door such that the over-the-door rack extends away from the top horizontal plane of a door and such that the first hanging member is positioned lower than a middle of a vertical length of the door.

21 Claims, 17 Drawing Sheets

(56) References Cited

U.S. PATENT DOCUMENTS 3,178,033 A * 4/1965 Wirsing ..... A47K 10/14 211/119.009
3,610,426 A * 10/1971 Thomas ..... A47B 61/003 211/117
3,800,958 A * 4/1974 Dorn ..... A47B 65/00 211/181.1
4,108,084 A * 8/1978 Fink ..... A47B 61/003 108/149
4,111,309 A * 9/1978 Henry ..... A47B 61/02 211/104
4,126,231 A * 11/1978 Derwent-Wryde ..... B42F 15/00 211/99
4,239,170 A * 12/1980 Planebo ..... A47B 97/001 248/447.1
4,253,577 A * 3/1981 Macfarlane ..... A47G 25/18 211/118
4,343,404 A * 8/1982 Folsom ..... B25H 1/0007 211/17
D287,550 S 1/1987 Tocci
4,846,430 A 7/1989 Ke
5,019,126 A * 5/1991 Post ..... A47G 25/0685 211/100
5,067,621 A * 11/1991 Alexander ..... A47G 25/02 211/117
5,098,108 A * 3/1992 McKinney ..... A63B 21/1645 211/119.004
D354,412 S 1/1995 Emery
5,526,943 A * 6/1996 Thompson ..... A47B 81/00 211/119.004
5,570,642 A * 11/1996 Lehrman ..... D06F 81/06 108/134
D381,225 S 7/1997 Malik
5,645,178 A * 7/1997 Conley, Jr. ..... A47F 5/08 211/87.01
5,695,072 A * 12/1997 Terragni ..... A47G 25/02 211/1.51
5,695,073 A 12/1997 Klein et al.
D393,970 S 5/1998 Lee
D403,187 S 12/1998 Klein et al.
5,842,581 A * 12/1998 Graefe ..... B25H 1/0014 211/17
5,875,902 A * 3/1999 Emery ..... A47B 96/16 108/29
5,894,940 A 4/1999 Gusdorf et al.
6,052,918 A * 4/2000 Oletzke ..... D06F 57/12 211/119.004
6,074,076 A * 6/2000 Parrish-Bhagwat ..... A46B 15/0002 15/167.1
6,223,914 B1 5/2001 Snell
6,267,257 B1 * 7/2001 DeBruyn ..... A47G 25/06 211/106
6,464,086 B1 * 10/2002 Klein ..... A47B 96/16 211/35
6,464,091 B1 * 10/2002 Nagasaki ..... A47G 25/0685 211/1.3
D471,389 S 3/2003 Kollner
D471,746 S 3/2003 Kollner
6,575,416 B1 * 6/2003 Avinger ..... A47G 25/0614 248/215
6,581,786 B1 6/2003 King
6,691,878 B1 * 2/2004 Ouitz ..... A47B 97/00 211/103
D501,106 S 1/2005 Suero, Jr.
6,877,614 B2 4/2005 Hu
D525,062 S 7/2006 Abdi et al.
D526,520 S 8/2006 Clucas
7,097,048 B2 8/2006 Rimback
7,178,769 B2 2/2007 Magnusson
7,234,603 B1 * 6/2007 Harris ..... A47F 5/0087 211/100
7,237,687 B1 * 7/2007 Abdi ..... A47G 25/0685 211/119.004
7,293,662 B2 11/2007 Klein
7,624,900 B2 * 12/2009 McLaughlin ..... A47G 25/32 223/85
7,810,655 B2 10/2010 Wang
7,866,493 B1 * 1/2011 Hurt ..... A47B 96/16 211/113
7,992,833 B1 * 8/2011 Goodman ..... A47G 25/0614 248/298.1
8,342,470 B2 * 1/2013 Shortell ..... A01G 5/04 211/119.004
8,371,457 B2 * 2/2013 Entz ..... A47B 43/00 211/85.7
8,439,210 B1 5/2013 Griffith
8,573,416 B2 * 11/2013 Didehvar ..... A47B 45/00 211/119.009
8,607,995 B1 * 12/2013 Mladinich ..... A47G 29/1223 211/104
8,636,156 B2 1/2014 Malik
8,672,146 B1 * 3/2014 Cole ..... A47B 61/003 211/117
8,844,737 B2 9/2014 Bukowski
8,870,148 B2 * 10/2014 Hickman ..... A47B 97/04 211/119.004
8,925,740 B1 1/2015 Fanok
D723,295 S 3/2015 Ruiz
9,770,102 B2 * 9/2017 Conod ..... A47B 47/0083
10,080,917 B2 * 9/2018 Freudinger ..... A63B 21/0442
2003/0150828 A1 * 8/2003 Bennett ..... A47B 97/04 211/118
2004/0173550 A1 * 9/2004 Adams ..... A47G 25/0614 211/118
2012/0097628 A1 * 4/2012 Blacknell ..... A47B 45/00 211/85.3
2012/0241398 A1 * 9/2012 Lam ..... A47G 25/0685 211/85.3
2012/0267331 A1 * 10/2012 Cittadino ..... A47F 5/10 211/118
2013/0264300 A1 * 10/2013 Shaffer ..... A47F 5/0006 211/117
2014/0103000 A1 * 4/2014 Avissar ..... A47G 25/0614 211/85.3
2014/0353267 A1 * 12/2014 Knutson ..... A47G 25/0614 211/118
2016/0007741 A1 * 1/2016 Carpinelli ..... G09F 23/00 211/85.3
2017/0119152 A1 * 5/2017 Zhu ..... A47B 61/04
2017/0254012 A1 * 9/2017 Barre ..... A47G 25/0614
2018/0055264 A1 * 3/2018 Mustafa ..... A47G 25/1457
2019/0104874 A1 * 4/2019 Baines ..... A47G 25/0614

* cited by examiner

ACCESSABILITY ENABLING OVER-THE-DOOR RACK

FIELD OF TECHNOLOGY

The subject matter disclosed herein relates generally to racks. More particularly, the present disclosure concerns over the door racks that are accessible to children and individuals with limited mobility.

BACKGROUND

People often hang towels and garments in particular locations in their homes. These locations may include door knobs, shower curtain rods, door corners, hooks driven into the wall, and installable towel racks or rods that are mounted on doors or walls or the like. Over-the-door racks are another means of hanging towels and garments. Often, parents and caregivers wish to teach children more responsibility by giving children responsibilities around the house like having a child hang up their towel to dry or hang their clothing. However, over-the-door racks are not user friendly for children because they are not accessible by a child, and the hooks available thereon are difficult for children to use. Over-the-door racks can also be difficult for persons with physical disabilities or limitations to use. Accordingly, a need exists for an over-the-door rack that is easily accessible and usable by children, persons with physical disabilities or limitations, and persons with heights less than an average height.

SUMMARY

According to one embodiment, an over-the-door rack comprises a first suspension hook configured to be placed over a top horizontal plane of a door such that the first suspension hook rests on the top horizontal plane of the door and a second suspension hook configured to be placed over the top horizontal plane of a door such that the second suspension hook rests on the top horizontal plane of the door. The over-the-door rack further comprises a first vertical member operatively attached to the first suspension hook and a second vertical member operatively attached the second suspension hook. The over-the-door rack further comprises a first hanging member operatively attached to the first vertical member and the second vertical member such that the first hanging member defines a bottom edge of the over-the-door rack. The first hanging member comprises a plurality of double hooks. Each double hook of the plurality of double hooks comprises a continuous ring of rigid material curved into a first hook portion and a second hook portion. The first hook portion has a first length, and the second hook portion has a second length. The first length and the second length are different. Each double hook of the plurality of double hooks further comprises more than one attachment point. A second hanging member is operatively attached to the first vertical member and the second vertical member and comprises a plurality of hooks. Each hook of the plurality of hooks has a single attachment point. The over-the-door rack is configured to extend away from the top horizontal plane of a door such that the first hanging member is positioned lower than a middle of a vertical length of the door when the over-the-door rack is affixed to the door.

According to another embodiment, an over-the-door rack kit comprises a first suspension hook configured to be placed over a top horizontal plane of a door such that the first suspension hook rests on the top horizontal plane of the door and a second suspension hook configured to be placed over the top horizontal plane of a door such that the second suspension hook rests on the top horizontal plane of the door. The over-the-door kit further comprises a first vertical member configured to operatively attach to the first suspension hook and a second vertical member configured to operatively attach to the second suspension hook. The over-the-door rack kit further comprises a first hanging member configured to operatively attached to the first vertical member and the second vertical member such that the first hanging member defines a bottom edge of the over-the-door rack. The over-the-door rack kit further comprises a plurality of double hooks. Each double hook of the plurality of double hooks comprises a continuous ring of rigid material curved into a first hook portion and a second hook portion. The first hook portion has a first length, the second hook portion has a second length, and the first length and the second length are different. Each double hook of the plurality of hooks is configured to releaseably attach to the first hanging member. Each double hook of the plurality of double hooks further comprises more than one attachment point. The over-the-door rack kit further comprises a second hanging member configured to operatively attach to the first vertical member and the second vertical member, and a plurality of hooks configured to releaseably attach to the second hanging member. Each hook of the plurality of hooks has a single attachment point. The over-the-door rack is configured to be assembled such that the over-the-door rack extends away from the top horizontal plane of a door such that the first hanging member is positioned lower than a middle of a vertical length of the door when the over-the-door rack is affixed to the door.

These embodiments enable children, persons with physical disabilities or other limitations, and persons having a height that is less than an average height to affix an over-the-door rack to a door, and to use an over-the-door rack to hang their towels, garments, and other items, without assistance from others. Children who may learn responsibility or otherwise benefit from completing the task of hanging their wet towel or garment after a bath or shower are often incapable of doing so because over-the-door racks are not accessible to them and hooks on over-the-door racks are difficult for children to access and use. The embodiments described herein enable children to take on responsibility of hanging their own towels and garments by facilitating child access to an over-the-door rack, and providing child-friendly hook configurations. The low-hanging double hook configuration provides multiple attachment points for children to use in hanging their towels and garments, and provides more secure hanging of towels, garments, and other items by children who may be new to hanging and storing towels and garments in this manner by themselves. Additional hooks available on the over-the-door rack may have single attachment points for adults to use as well.

Additional embodiments include additional child-friendly features that enhance the teaching capability of an over-the-door rack. For example, name slots on an over-the-door rack enable children to experience a sense of ownership and pride when they are hanging their towel or garment in their designated location, and teaches cooperation and sharing when multiple children are using the over-the-door rack. As another example, hooks having educational shapes like letters and numbers enable a child to assist a parent or caregiver with the assembly of the over-the-door rack, and teach children to exhibit independence in choosing the configuration of the over-the-door rack. A child may be given further independence and sense of accomplishment with the addition of a child-accessible mirror that provides a place for a child to brush their teeth or get dressed after hanging their bath towel, bathrobe, or other item on the over-the-door rack all by themselves. Further, the independence of and ease of self-care for individuals with physical disabilities or limitations or individuals who have a height that is less than an average height can be enhanced by embodiments described herein.

These embodiments also enhance the sanitation and cleanliness of towel and garment hanging and storage by enabling wet towels and garments to be spread out when drying on the over-the-door rack. It is often the case that the hooks or protrusions available do not allow wet towels or garments to be spread out enough to dry efficiently, because when for example, a wet towel is hung on a hook, the towel material tends to fold around itself in a number of folds, thereby enclosing the wet or moist areas. This is especially true for towels and bath time garments designed for children that often have hoods, and hand or arm coverings. Particularly in bathrooms where steam and moisture from use of a sink, bath, or shower may linger long after a user has finished using the bathroom, a number of unfavorable consequences can result from ineffectual hooks and protrusions that cause wet towels and garments to fold in on themselves. For example, it can take hours for towels and garments to fully dry, which can cause odor and mold to emerge on the towel or garment material itself. As another example, where a door is made out of a porous material like wood, or has a delicate painted finish or veneer, lingering moisture from long-drying wet towels and garments can cause unsightly marks and mold on the surface of the door next to where a towel or garment is hanging. Negative health consequences may result, particularly for children and persons with physical disabilities or limitations that may also be elderly. The embodiments herein combat these health risks thereby preventing the aforementioned drying conditions, thereby protecting children who are learning responsibility of hanging their own towel and garments on an over-the-door rack from health hazards.

BRIEF DESCRIPTION OF THE DRAWINGS

Some of the embodiments will be described in detail, with reference to the following figures, wherein like designations denote like members, wherein.

DETAILED DESCRIPTION

Figure 1:
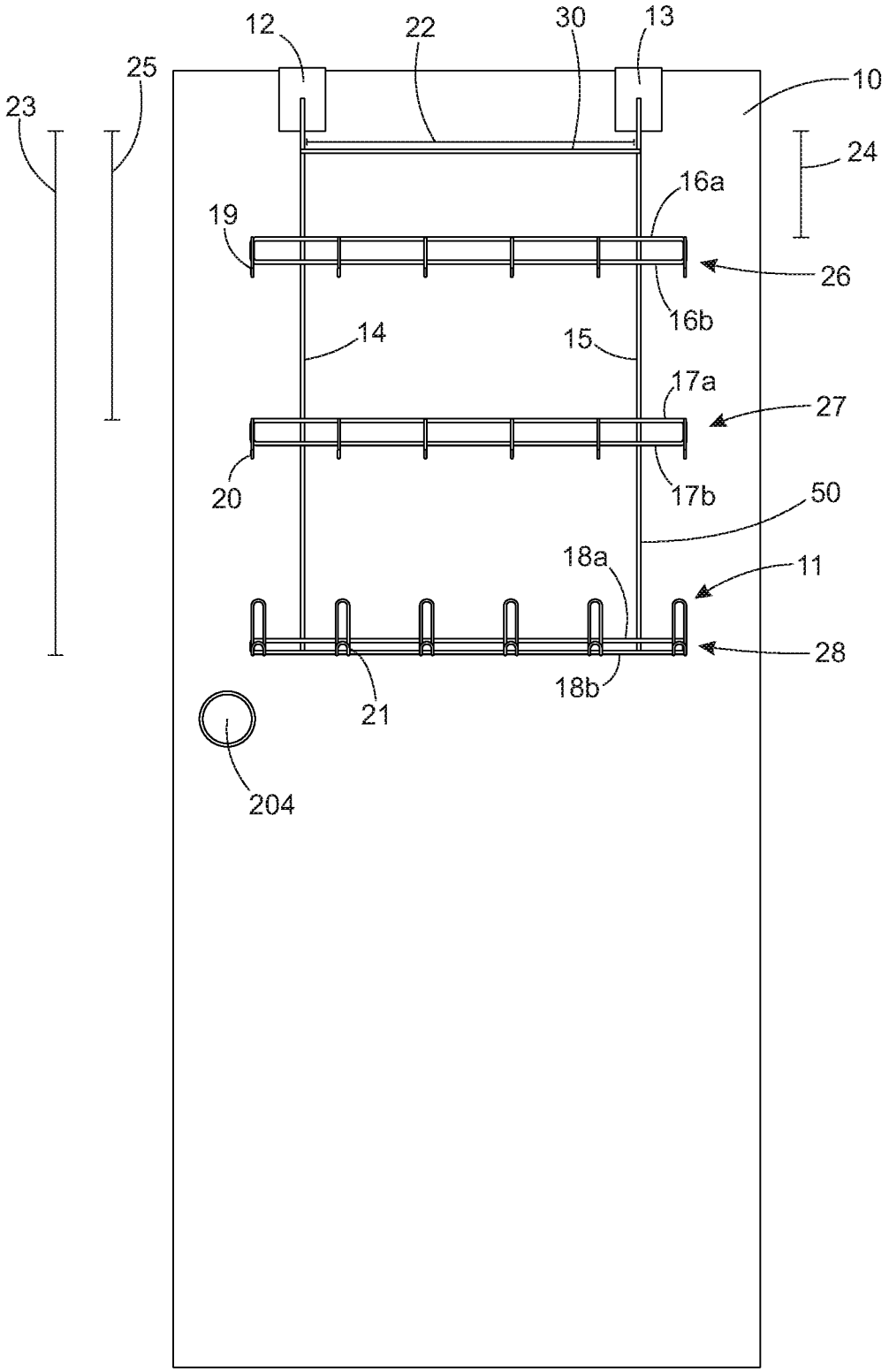
FIG. 1 is a front view of an embodiment of a over-the-door rack having multiple hanging members with different hooks.

Embodiments of the present invention can be modified in various forms, and the scope of embodiments of the present invention should not be construed as being limited to embodiments described below. The embodiments are provided to fully describe embodiments of the present invention to those of ordinary skill in the art. Therefore, in the drawings, shapes of components and the like are exaggerated for clarity of description.

Referring to FIG. 1, a front view of an over-the-door rack 11 is shown hung over a top horizontal plane of a door 10. Over-the-door rack 11 has an entire surface area 50. Over-the-door rack 11 is shown affixed to the door 10 by two "C" shaped suspension hooks 12, 13 that rest over the top horizontal plane of the door 10. Extending from suspension hook 12 is a vertical member 14. Extending from suspension hook 13 is a vertical member 15. Vertical members 14 and 15 extend for a first length 23 towards a bottom horizontal plane of the door 10. Vertical members 14 and 15 extend parallel to one another. Vertical member 14 and vertical member 15 may be separated from each other by a distance 22. The distance 22 between vertical member 14 and vertical member 15 is equal at each location along the length 23. Proximate to the top horizontal plane of the door 10, a horizontal support member 30 is shown extending between vertical member 14 and vertical member 15. The horizontal support member 30 may provide structural integrity to the over-the-door rack 11 so that vertical member 14 and vertical member 15 do not spread apart from one another during use of the rack 11.

In an exemplary embodiment, shown extending across vertical members 14 and 15 is a hanging member 26. Hanging member 26 is located a distance 24 away from suspension hooks 12, 13. Hanging member 26 comprises a first horizontal member 16*a* and a second horizontal member 16*b*. First horizontal member 16*a* and second horizontal member 16*b* extend horizontally parallel to one another. Hanging member 26 further comprises a plurality of rounded hooks 19 equidistant apart from one another disposed along hanging member 26.

Shown extending across vertical members 14 and 15 is hanging member 27. Hanging member 27 is located a distance 25 away from suspension hooks 12, 13. Hanging member 27 comprises a third horizontal member 17*a* and a fourth horizontal member 17*b*. Third horizontal member 17*a* and fourth horizontal member 17*b* extend horizontally parallel to one another. Hanging member 27 further comprises a plurality of rounded hooks 20 equidistant apart from one another disposed along the hanging member 27.

Shown extending across vertical members 14 and 15 is hanging member 28. Hanging member 28 is shown at a distance 23 from suspension hooks 12, 13. Hanging member 28 comprises a fifth horizontal member 18*a* and a sixth horizontal member 18*b*. Fifth horizontal member 18*a* and sixth horizontal member 18*b* extend horizontally parallel to one another. Hanging member 28 further comprises a plurality of double hooks 21. The double hooks 21 may extend lower than the ends of the vertical members 14 and 15.

Over-the-door rack 11 may be made out of metal, plastic, wood, bamboo, or any other substantially rigid material. For example, over-the-door rack 11 may be made out of material made from recycled plastic bottles, or other recycled material. Vertical members 14, 15, horizontal support member 30, and hanging members 26, 27, and 28 may be solid, or may be hollow. For example, the horizontal support member 30 may be a hollow tube. A hollow configuration may reduce the overall weight of the over-the-door rack, which may be preferable to enable children and persons with physical disabilities or limitations to lift the over-the-door rack 11 to place the over-the-door rack 11 over the top horizontal plane of the door 10 such that the suspension hooks 12, and 13 are resting over the top horizontal plane of the door 10 and the over-the-door rack 11 is securely affixed to the door 10.

While the hanging members 26, 27, and 28 are shown extending across and past the vertical members 14, 15 wider than the distance 22, it should be understood that the hanging members 26, 27, and 28 could be configured to extend between the vertical members 14, 15 such that no part of the hanging members 26, 27 and 28 are extending wider than the distance 22.

As shown in FIG. 1, in one embodiment, the over-the-door rack 11 extends towards the bottom horizontal plane of the door 10, and hanging member 28 rests against the door 10 proximate to the middle of the vertical length of the door 10. This embodiment helps permit children, persons with disabilities or physical limitations, and persons with a height that is less than an average height to reach the over-the-door rack 11 to be able to hang towels and garments thereon. The middle of the vertical length of the door 10 may be defined by the exact middle of the vertical length of the door 10, the location of a door knob or handle on the door 10, the location of a metal panel affixed to the door 10 for pushing the door 10 open, or a bar configured to depress and release a latch bolt or dead bolt of a door 10, and the like.

Figure 2A:
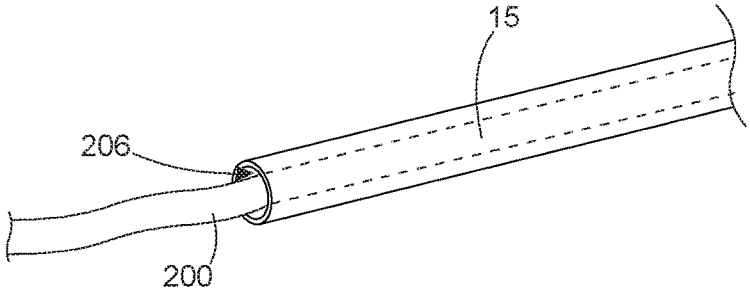
FIG. 2A is a perspective view of an embodiment of a vertical member of the over-the-door rack according to one embodiment.
Figure 2B:
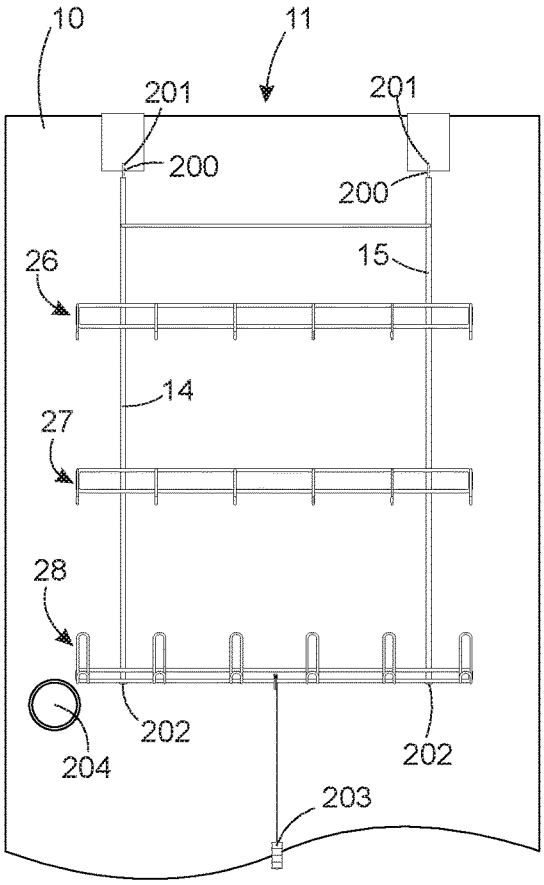
FIG. 2B is a front view of the over-the-door rack according to one embodiment in which the over-the-door rack is in a contracted position.
Figure 2C:
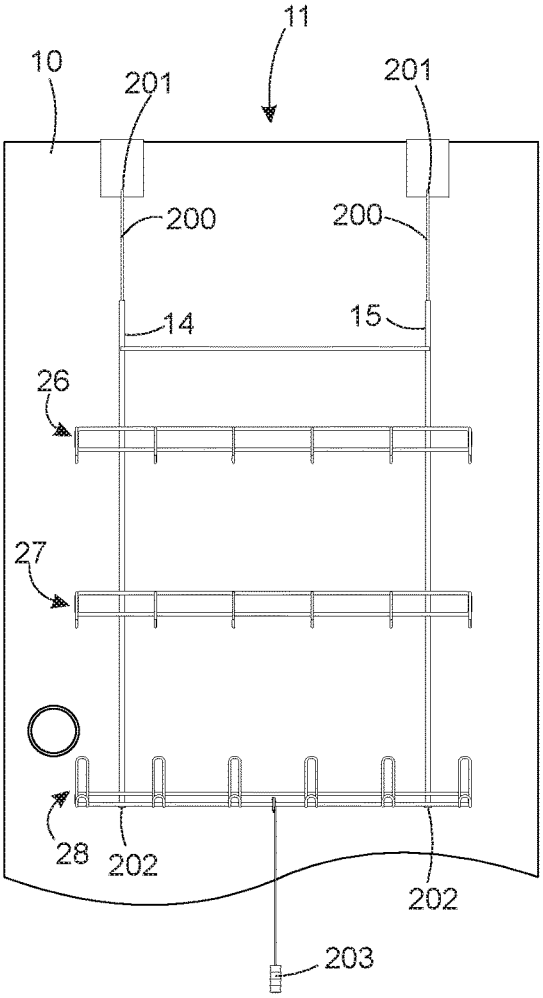
FIG. 2C is a front view of the over-the-door rack according to one embodiment in which the over-the-door rack is in an extended position.

In another embodiment, the vertical members 14, and 15 may be hollow, and have an opening 206 that extends through the entire length of each of vertical member 14, and 15, as shown with respect to vertical member 15 in FIG. 2A. With reference to FIGS. 2B and 2C, extending from each suspension hook 12, and 13 is a length of elastic cord 200. Each length of elastic cord 200 has a first end 201 that is attached to one of suspension hooks 12, 13, and a second end 202 having a knot that prevents the vertical members 14, 15 from sliding off of the lengths of elastic cord 200. The second end 202 is not limited to having a knot and could have any component that is wider than the opening 206 of the vertical members, such as a bead, a washer, a bulge, a toggle, and the like that prevents the vertical members 14, 15 from sliding off the lengths of elastic cord 200. As another example, the second end 202 may be attached to the opening 206 by glue, tape, or other adhesive material. Each length of cord 200 extends through vertical member 14, 15 through openings 206. A handle 203 may extend from the middle of hanging member 28 or any hanging member disposed on the over-the-door rack 11. A child, a person with a disability or a person having a height that is less than an average height may use the over-the-door rack 11 to hang a towel or garment by pulling down the handle 203. The lengths of elastic cords 200 will releaseably extend by stretching, allowing hanging member 28 to be pulled down lower as shown in FIG. 2C so that the child, a person with a disability or a person having a height that is less than an average height can reach hanging member 28, and other hanging members. When the child, a person with a disability or a person having a height that is less than an average height has hung up the towel or garment, they can release the handle and the lengths of the elastic cords 200 will retract to their original length and the over-the-door rack 11 will return to its higher position on the door as shown in FIG. 2B such that the towel or garment does not touch the floor when it is hanging and drying. For example, in FIG. 2B, hanging member 28 is shown positioned above the door knob 204 of the door 10, and in FIG. 2C, hanging member 28, having been pulled downwards, is lower than the door knob 204. The elastic cords 200 could be any extendable member, for example, a first extendable member extending through vertical member 14 and a second extendable member extending through vertical member 15. An extendable member may be any stretchable or elastic material, for example, a length of rubber, a woven fabric cord, a chain of elastic bands, or the like. The over-the-door rack is not limited to being extendable by elastic cords 200, for example, an first extending member and a second extending member could each be a telescoping rod of any material. As another example, the vertical members 14, 15 could be spring loaded.

Figure 3A:
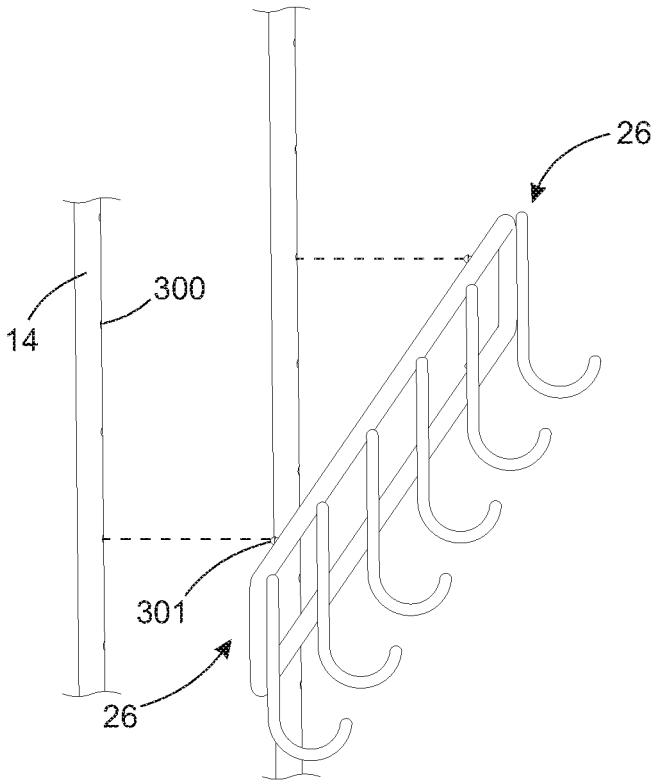
FIG. 3A is a perspective view of two vertical members and a hanging member of the over-the-towel rack according to one embodiment in which the vertical members and the hanging member are not attached.
Figure 3B:
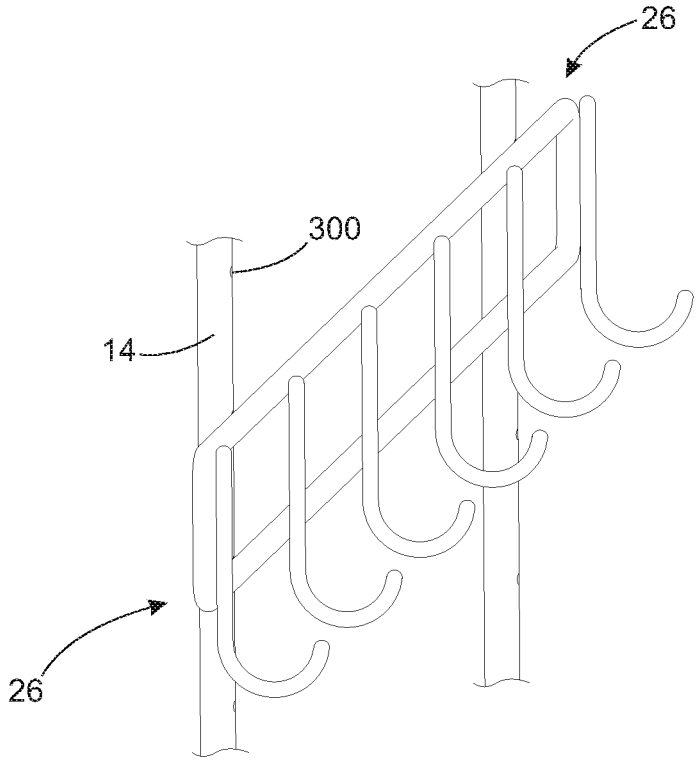
FIG. 3B is a perspective close-up view of two vertical members and a hanging member of the over-the-towel rack according to one embodiment in which the vertical members and the hanging member are attached.

Hanging members 26, 27, and 28 are not limited to being permanently disposed on the vertical members 14, and 15 in a single position. Hanging members 26, 27, and 28 may be releaseably attachable to the over-the-door rack 11. For example, in another embodiment, as shown in FIGS. 3A and 3B with respect to vertical members 14, 15, the vertical members 14, and 15 may each have a plurality of holes 300 disposed along a length of each vertical member 14, and 15. Each of hanging members 26, 27, and 28 may comprise at least one protrusion 301 configured to be releaseably pressed into a hole 300 of a vertical member 14, or 15, such that a user can secure each of hanging members 26, 27, and 28 to the over-the-door rack 11 at any location along the length of the over-the-door rack 11 as shown in FIG. 3B with respect to hanging member 26. In this embodiment, a user can attach one hanging member, two hanging members, three hanging members, or more onto the over-the-door rack 11, at different spaces apart depending on the desired configuration. For example, if a user wishes to hang short garments, like children's towels and clothes on the over-the-door rack 11, the user may decide to secure the hanging members to the over-the-door rack 11 closer together because children's garments and towels may hang shorter on the over-the-door rack 11 than a full-size towel or adult garments. As another example, a user in a wheelchair, may choose secure the hanging members 26, 27, and 28 a farther distance away from the suspension hooks 12, 13 and closer to a middle portion of the vertical length of the door for easier access. As another example, an adult user who wishes to have their child hang the child's towel on the over-the-door rack 11 after the child has bathed may also wish to store the adult user's items on the over-the-door rack 11 while keeping those items out of reach of the child. In this instance, a user may secure hanging member 26 to the over-the-door rack 11 near the suspension hooks 12, 13 to hang or store items desired to be kept out of reach of the child, and may secure hanging member 28 a farther distance away from the suspension hooks 12, 13 and closer to a middle portion of the vertical length of the door 10 on which the child can access and hang the child's towel. Hanging members 26, 27, and 28 are not limited to being releaseably attachable by holes 300 and protrusions 301, and could be releaseably attachable by Velcro®, adhesive, buttons, tabs, and the like. As another example, the hanging members 26, 27, and 28 may be spring loaded along a length of each of the hanging members 26, 27, and 28, and may be attached to the over-the-door rack 11 by contracting the spring, placing the hanging members 26, 27, and 28 in between the vertical members 14, and 15 and releasing the springs of the hanging members 26, 27, and 28 when each is positioned as desired by the user. As another example, the vertical members 14, 15 may have a plurality of ridges, and hanging members 26, 27, and 28 may have tabs or other protrusions configured to snap, be pressed into, or otherwise securely engage with the plurality of ridges. As yet another example, the hanging members 26, 27, and 28 may have hooks that may be placed into the plurality of holes 300 such that the hanging members 26, 27, and 28 are releaseably attached to the over-the-door rack 11.

Figure 4:
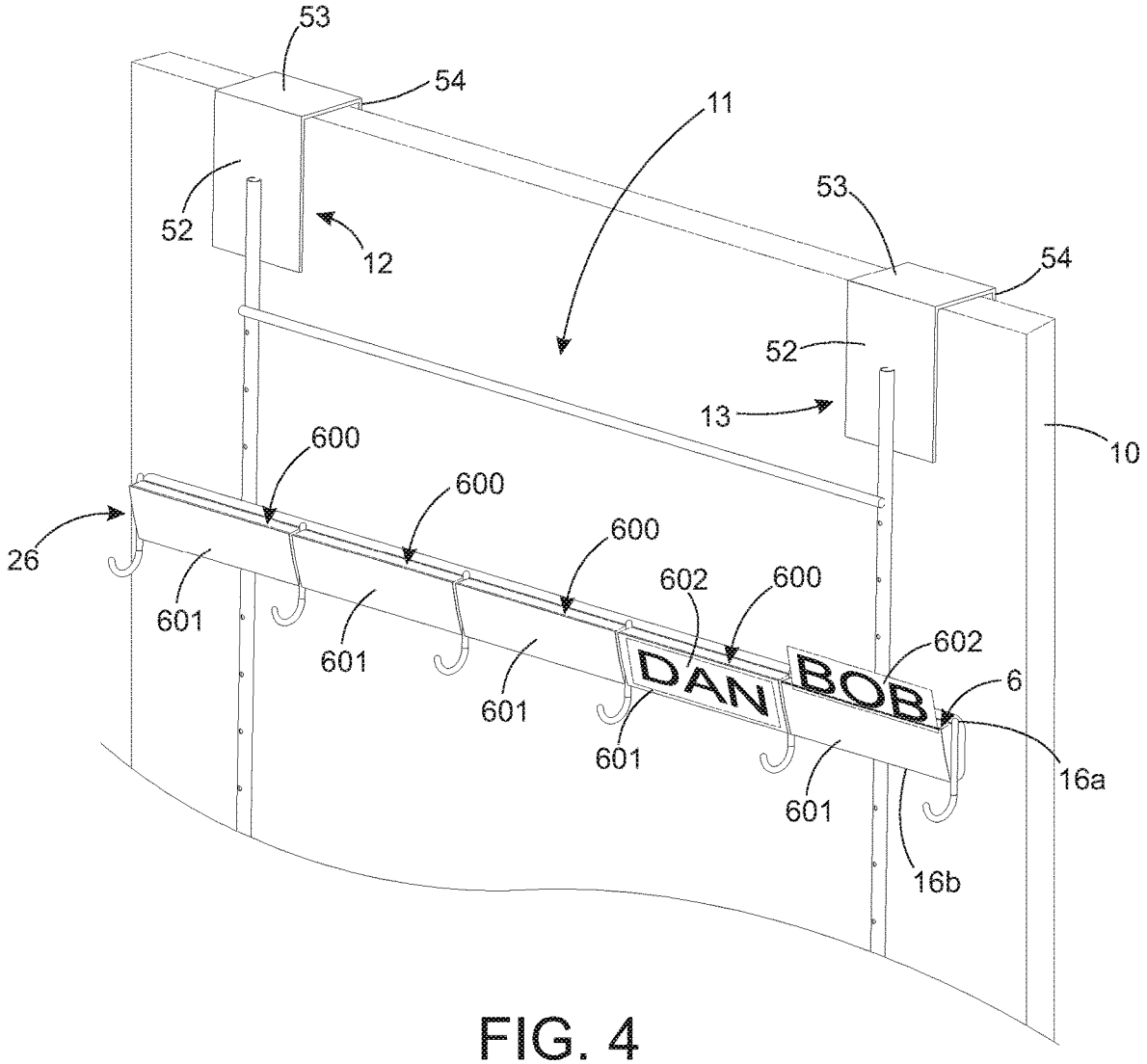
FIG. 4 is a partial close-up view of the over-the-door rack according to one embodiment in which the suspension hooks of the over-the-door rack are shown in detail.

Referring now to FIG. 4, a perspective view is shown of the suspension hooks 12, and 13 having been placed over the top horizontal plane of the door 10. Suspension hooks 12, and 13 have a front portion 52 that extends vertically down the surface of the door 10 on which the over-the-door rack 11 hangs, a top portion 53 that extends horizontally across the top horizontal plane of the door 10, and a back portion 54 that extends vertically down the surface of the door 10 opposite the side on which the over-the-door rack 11 hangs. It should be understood that the suspension hooks 12, and 13 are not limited to being "C" shaped. In addition, the top portion 53 of the suspension hooks 12, and 13 may be configured to be wide enough to accommodate an average width of a top horizontal plane of an average door 10. As another example, the top portions 53 may be adjustable, for example, the top portions 53 may comprise two telescoping portions that can extend or retract to accommodate doors having different widths. As another example, the suspension hooks 12, and 13 may be made of releasable clamps that have a default closed position wherein the front portion 52 and back portion 54 are pressed together, and wherein the suspension hooks 12, and 13 may be placed in an open position by separating the front portion 52 and back portion 54 to place the top horizontal plane of the door 10 in between the front portion 52 and the back portion 54.

Further, the over-the-door rack 11 is not limited to hanging on a door by two suspension hooks 12, 13. For example, in another embodiment, the over-the-door rack 11 may have straps that extend vertically along the door 10 around the top horizontal plane of the door 10, down the side of the door opposite to the over-the-door rack 11, around the bottom horizontal plane of the door 10, and back up the side of the door 10 on which the over-the-door rack 11 hangs, and attached to hanging member 28. The straps could be elastic straps, leather straps, fabric straps, and the like, and could attach to hanging member 28 by Velcro®, magnets, hooks, tabs, buttons, toggles, latches, and the like. As another example, the suspension hooks 12, and 13 may be straps with "C" shaped suspension hooks at the end, and extend vertically around the top horizontal plane of the door 10, down the side of the door opposite to the over-the-door rack 11, and grasp the bottom horizontal plane of the door 10 by means of the "C" shaped suspension hooks in the same manner as the suspension hooks 12, and 13 are shown in FIG. 2 in relation to the top horizontal plane of the door 10.

The suspension hooks 12, and 13 may be enclosed in a rubber coating, for example, PLASTI DIP®, or other waterproof coating. This may protect the suspension hooks 12, and 13 from rusting or other water damage, and accordingly may protect the surface of the door 10 from scratches, marks, and rusting or other water damage. In addition, providing a rubber coating on suspension hooks 12, and 13 may help prevent the over-the-door rack from sliding back and forth on the top horizontal plane of the door 10 as the door 10 is opened and closed, and as towels or garments or other items are hung on and taken off the over-the-door rack 11. For individuals and families living in apartments or other rented housing, rules are often in place preventing the installation of any permanent fixtures, and prohibiting the marking, marring, drilling, scraping, or other damaging of doors, walls, and surfaces. Individuals and families living with such rules in place cannot use over-the-door racks that must be permanently affixed onto a door. Enclosing the suspension hooks 12, and 13 in a coating enables such individuals and families to use an over-the-door rack that will not damage a door. Further, the entire surface area 50 may be coated with a rubber coating. The coating is not limited to being rubber, and could be any waterproof, substantially waterproof, water-resistant material, or other material configured to protect the over-the-door rack 11 from rust, and to protect the door 10 from damage caused by contact with the over-the-door rack, for example, plastic, tape, and the like.

Also shown in FIG. 4 is an embodiment of hanging member 26 in which name card pockets 601 are disposed between horizontal member 16*a* and horizontal member 16*b*. Name card pockets 601 are shown having slots 600 into which name cards 602 can be inserted. This embodiment may applied to each hanging member 26, 27, and 28, and may be particularly advantageous on the hanging member positioned lowest on the over-the-door rack 11 so that children can have ownership of a part of a hanging member that they can use to hang their towel, garment, or other item. This enables a child to have a sense of pride in hanging their towel, garment, or other item, because they have a designated location to use and keep tidy. The name card pockets 601 may be made of plastic, glass, or other see-through material. The hanging member 26 and other hanging members are not limited to having name card pockets 601 into which name cards 602 can be inserted, and may instead be white boards or chalk boards on which a child could write its name with a dry-erase marker or chalk, respectively.

Figure 5A:
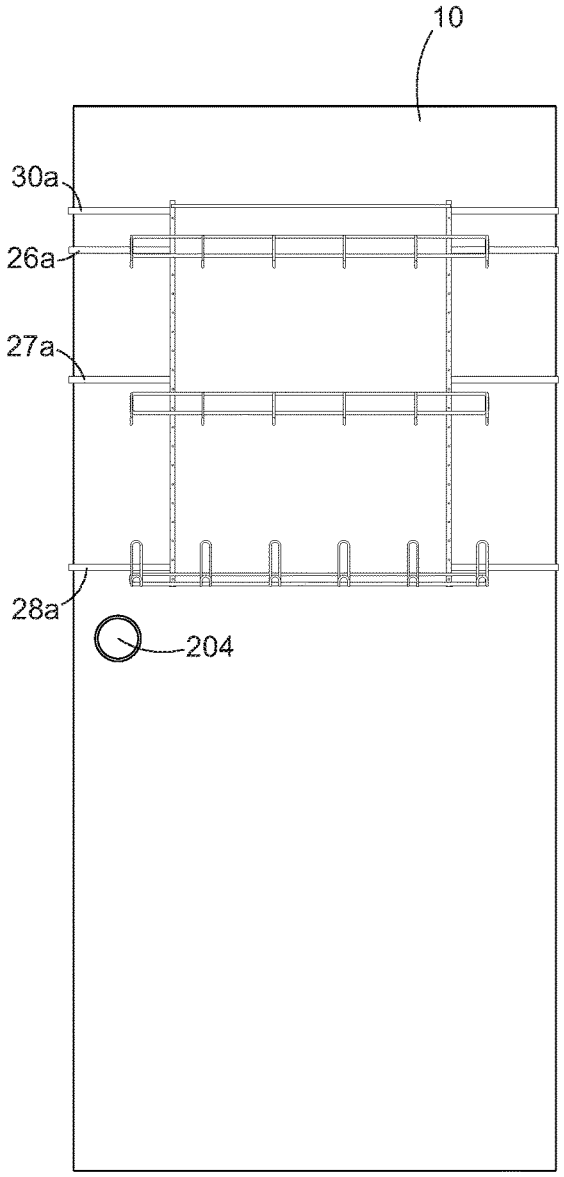
FIG. 5A is a front view of the over-the-door rack according to one embodiment wherein the over-the-door rack is attached to a door with straps.
Figure 5B:
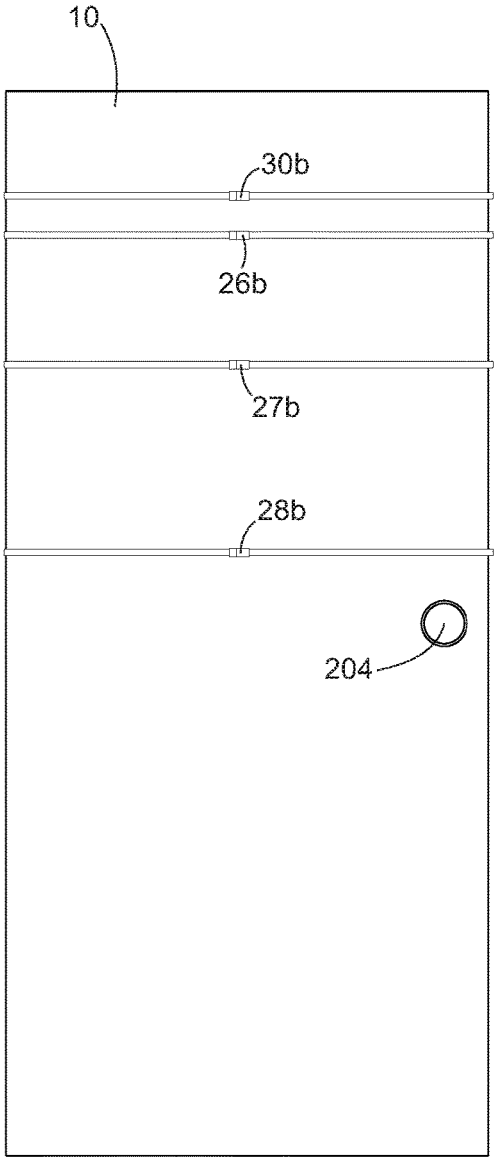
FIG. 5B is a back view of the straps of the over-the-door rack according to one embodiment secured by clasps on the back of the door.

Another embodiment is shown in FIGS. 5A and 5B, in which horizontal support member 30 may be made of a strap 30*a*, such as a strap made of leather, elastic, rubber, plastic, or the like, and be configured to extend horizontally around the door 10. In this embodiment, horizontal support member 30 may comprise and be secured by a clasp 30*b*, or other attachment mechanism such as Velcro®, magnets, hooks, tabs, buttons, toggles, latches, and the like. As another example, each of the horizontal support member 30, the hanging members 26, 27, and 28 may have a strap or set of straps configured to secure the over-the-door rack 11 by looping around the door 10, shown as 30*a*, 26*a*, 27*a*, and 28*a*. Each of these straps 30*a*, 26*a*, 27*a*, and 28*a* may be secured by a clasp, 30*b*, 26*b*, 27*b*, and 28*b*, respectively, or other attachment mechanism such as Velcro®, magnets, hooks, tabs, buttons, toggles, latches, and the like. The straps 30*a*, 26*a*, 27*a*, and 28*a* may be made of or coated with a non-slip material such as rubber to prevent movement of the over-the-door rack 11 when in use. The portion of the straps 30*a*, 26*a*, 27*a*, and 28*a* and any portion of the clasps 30*b*, 26*b*, 27*b*, and 28*b* that must be placed through the space between the door 10 and the frame of the door 10 may be flat, or have a width small enough for passage through the space between the door 10 and the frame of the door 10 such that the door 10 may open and close without becoming jammed, encumbered, stuck, or otherwise limited by the straps 30*a*, 26*a*, 27*a*, and 28*a* and clasps 30*b*, 26*b*, 27*b*, and 28*b*. In this embodiment, a first and second suspension hook may not be necessary to affix the over-the-door rack 11 to a door 10.

Figure 6A:
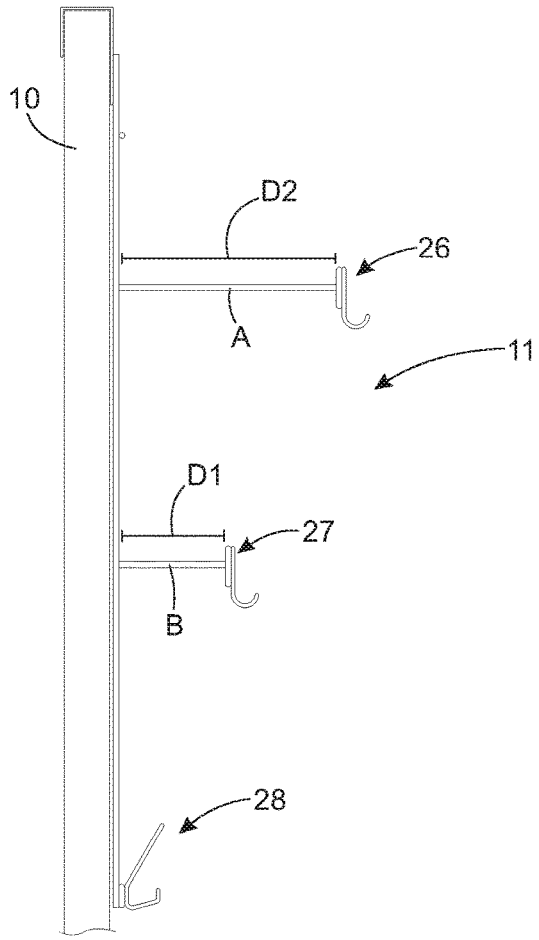
FIG. 6A is a side view of the over-the-door rack with hanging members that extend different distances from the over-the-door rack according to one embodiment.
Figure 6B:
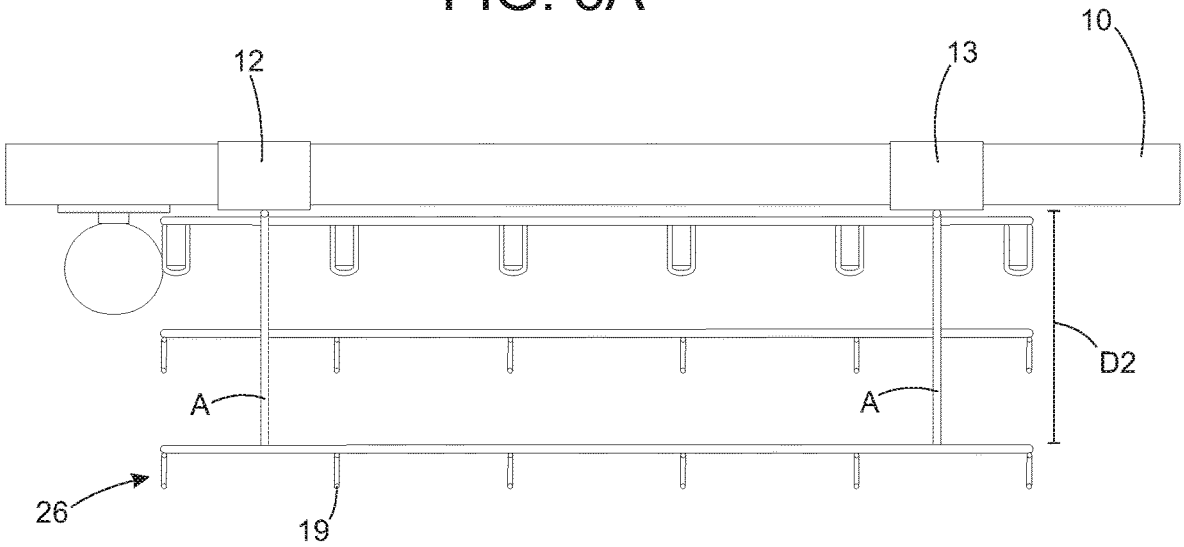
FIG. 6B is a top view of the over-the-door rack with hanging members that extend different distances from the over-the-door rack according to one embodiment.

Referring now to FIG. 6A, a side view of another embodiment of the over-the-door rack 11 is shown. The hanging member 27 extends a first distance D1 away from a door 10, in which the first distance is perpendicular to the door 10, by members B such that hanging member 27 is farther away from the door 10 than hanging member 28. Hanging member 26 is shown extending a second distance D2 away from the door 10, in which the second distance is perpendicular to the door 10, by members A such that hanging member 26 extends farther away from the door 10 than the third hanging member 28 and hanging member 27. In this embodiment, the first distance D1 and second distance D2 provide space for each of the hanging members 26, 27, and 28 to have towels or garments hanging thereon to dry such that the portion of towels and garments hanging down from the over-the-door rack 11 are not touching one another or laying on top of one another. This may facilitate faster drying and help prevent mold and odor from occurring. As shown in the top view in FIG. 6B, members A position the hanging member 26 a distance D2 away from the door 10. Additional towels or garments can be stored within the first distance D1 and second distance D2 between the hooks disposed on hanging member 27 and the vertical members 14, 15, and between the hooks disposed on hanging member 26 and the vertical members 14, 15, by laying a rolled up or folded towel across members A. Members A and members B may be solid material such as metal, wood, or plastic, or may be extendable, for example, by telescoping, or by an accordion or helical material that is retractably extendable.

Figure 7:
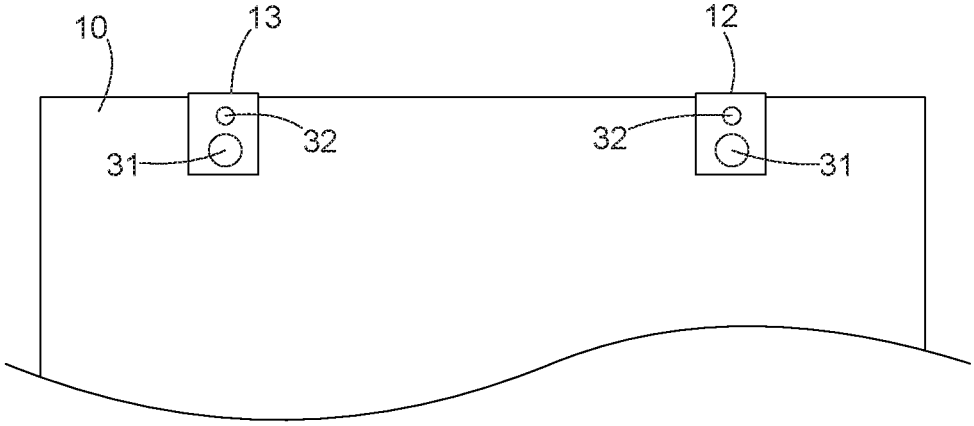
FIG. 7 is a back view of the suspension hooks of the over-the-door rack according to one embodiment.

Referring now to FIG. 7, a back view of the suspension hooks 12, and 13 are show extending over the top horizontal plane of the door 10 and onto the back of the door 10. Suspension hooks 12, and 13 are shown having a first set of holes 31, and a second set of holes 32. The first and second set of holes 31, and 32 may provide a user of the over-the-door rack the ability to permanently attach the over-the-door rack 11 to a door, by placing a fastener, such as a nail or screw through each of the first set of holes 31, the second set of holes 32, or both the first and second sets of holes 31, 32 into the door 10. The first and second sets of holes 31, 32 provide a user the option of permanent attachment if for example, the user purchases a home or does not have rules prohibiting marring or permanent alteration to the door. The first and second sets of holes 31, 32 are not limited to being located on the back portions 54, and may be located on the front portions 52, the top portions 53, or on a combination of portions 52, 53, and 54 of the suspension hooks 12, 13. It should be understood that the first and second sets of holes 31, 32 are not limited to being holes, and may be bores, perforations, slots, recesses, channels, or the like. Further, suspension hooks 12, 13 may have no sets of holes.

Figure 8:
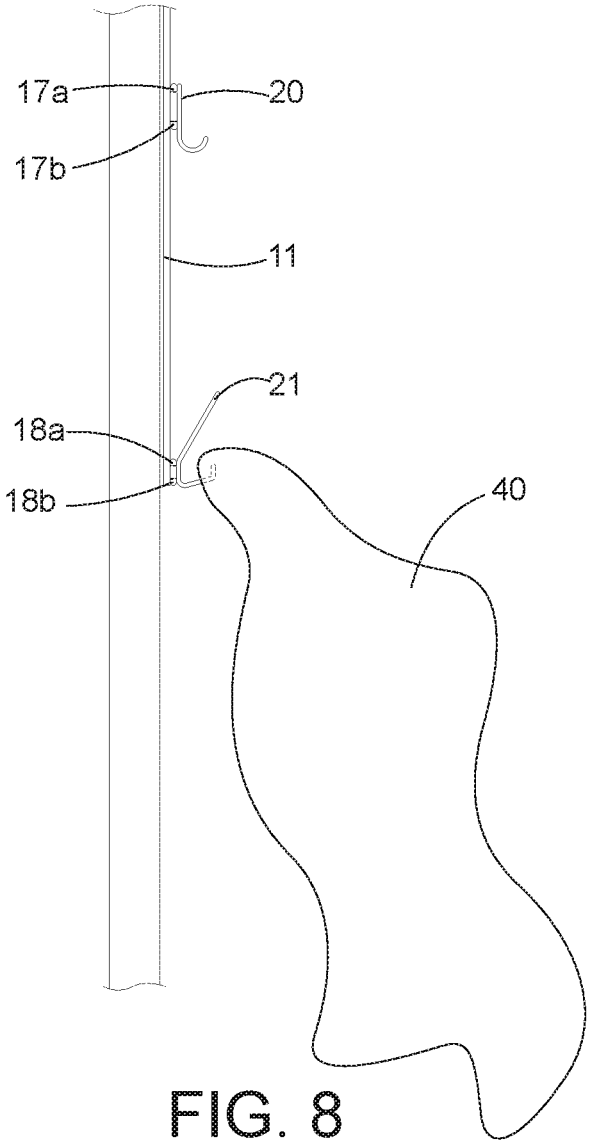
FIG. 8 is a partial side view of the over-the-door rack with a towel hung thereon according to one embodiment.

Referring now to FIG. 8, a side view of a portion of the over-the-door rack 11 according to one embodiment is shown. A rounded hook 20 is shown on hanging member 27 and a doublehook 21 is shown on hanging member 28. Double hook 21 is shown with a towel 40 hanging thereon. Rounded hook 20 and double hook 21 may have a textured coating to further prevent slippage of the towel 40 from the rounded hook 20. For example, rounded hook 20 and double hook 21 may have a series of ridges or rubberized bumps, or the like.

Figure 9A:
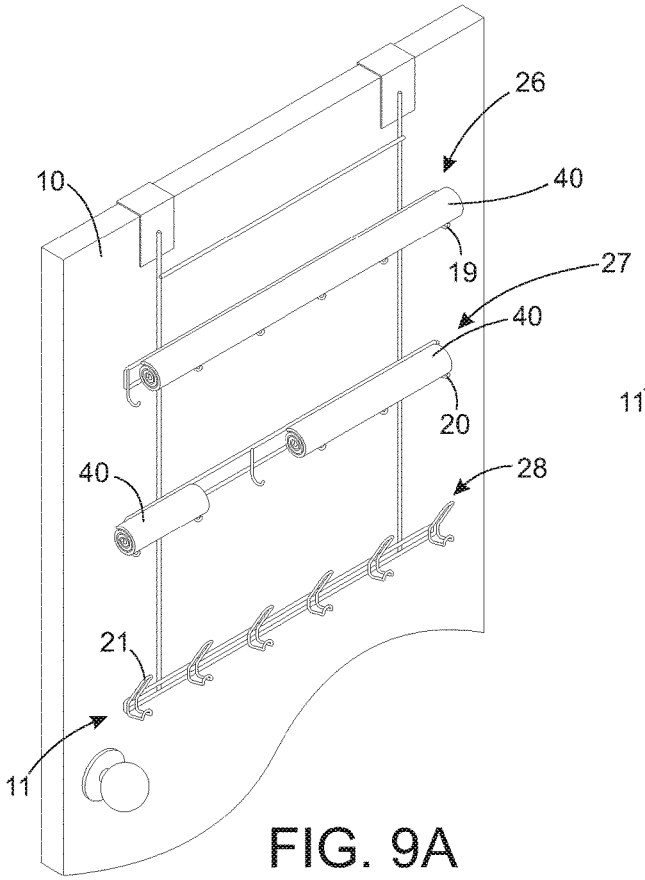
FIG. 9A is a front perspective view of the over-the-door rack with towels stored thereon according to one embodiment.
Figure 9B:
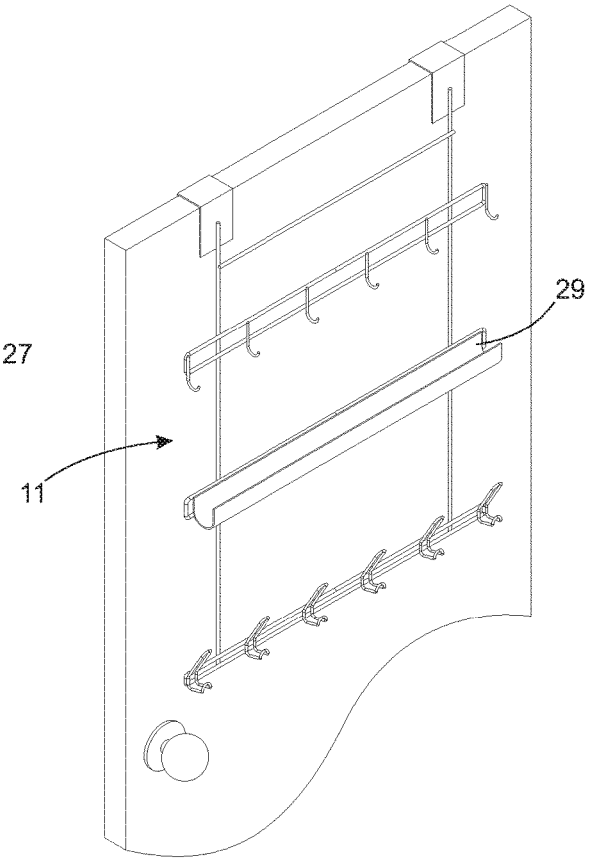
FIG. 9B is a front perspective view of the over-the-door rack having a shelf according to one embodiment.

Referring now to FIG. 9A, a front perspective view of the over-the-door rack 11 is shown, with the rounded hooks 19 being used to hold a single towel 40. As shown, a towel 40 may be rolled and placed horizontally onto the rounded hooks 19 for storage. This may be particularly useful for clean towels, or towels that have dried on the over-the-door rack 11. As shown with respect to hanging member 27, a user may also place more than one towel 40 across multiple of the rounded hooks 20. It should be understood that hanging members 26 and 27 are not limited to having rounded hooks 19, 20, and could each have a continuous curved shelf 29 as shown in FIG. 9B, or one of hanging members 26 and 27 could have a continuous curved shelf 29. Continuous curved shelf 29 could be made out of a material through which moisture can drip, such as mesh, or a screen, or may be a solid waterproof material such as plastic or treated wood or other material. It should be understood that continuous curved shelf 29 could have enclosed sides such that moisture from an object placed therein could be contained within the continuous curved shelf 29.

The over-the-door rack 11 is not limited to having three hanging members 26, 27, and 28, and could have less hanging members, or more than three hanging members. Further, it should be understood that the over-the-door rack 11 is not limited to having two different types of hooks: rounded hooks 19, 20, and double hooks 21. For example, each hanging member of the over-the-door rack 11 may have the same hooks, or may each have different hooks disposed thereon, or each may have a plurality of differently shaped hooks disposed thereon.

Figure 10:
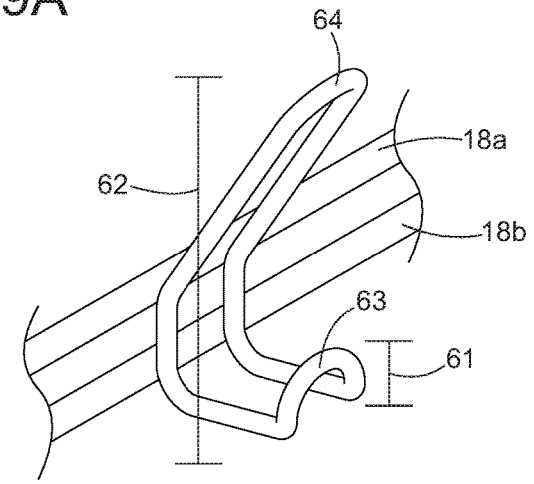
FIG. 10 is a close-up perspective view of a double hook of the over-the-door rack according to one embodiment.

Referring now to FIG. 10, a close-up perspective view of a double hook 21 is shown. The double hook 21 is a continuous ring of rigid material curved into a first hook portion 61 and a second hook portion 62. The first hook portion 61 extends to a first end portion 63. The second hook portion 62 extends to a second end portion 64. The second hook portion 62 that has a length greater than the length of the first hook portion 61. However, it should be understood that the length of the first hook portion 61 is not limited to being less than the length of the second hook portion 62. For example, first portion 61 and second portion 62 may have the same length. As another example, the second portion 62 may have a length that is less than the length of the first portion 61. Double hook 21 is shown as a continuous loop of material shaped into a curve that forms first hook portion 61 and second hook portion 62. Each of first hook portion 61 and second hook portion 62 provide an attachment point on which a child or other individual can hang a towel, garment, or other item. For example, a child could hang a towel on first hook portion 61, and a loofah or washcloth or body scrubber on the second hook portion 62. The continuous loop of material of double hook 21 provides a smooth surface that a child will not snag their towel or garment on, and protects children from rough hook end points that are present in other hooks. A child quickly hanging their towel on a double hook 21 cannot be injured by scraping their hand or arm on the double hook because the continuous loop of material does not have a rough end point.

Figure 11:
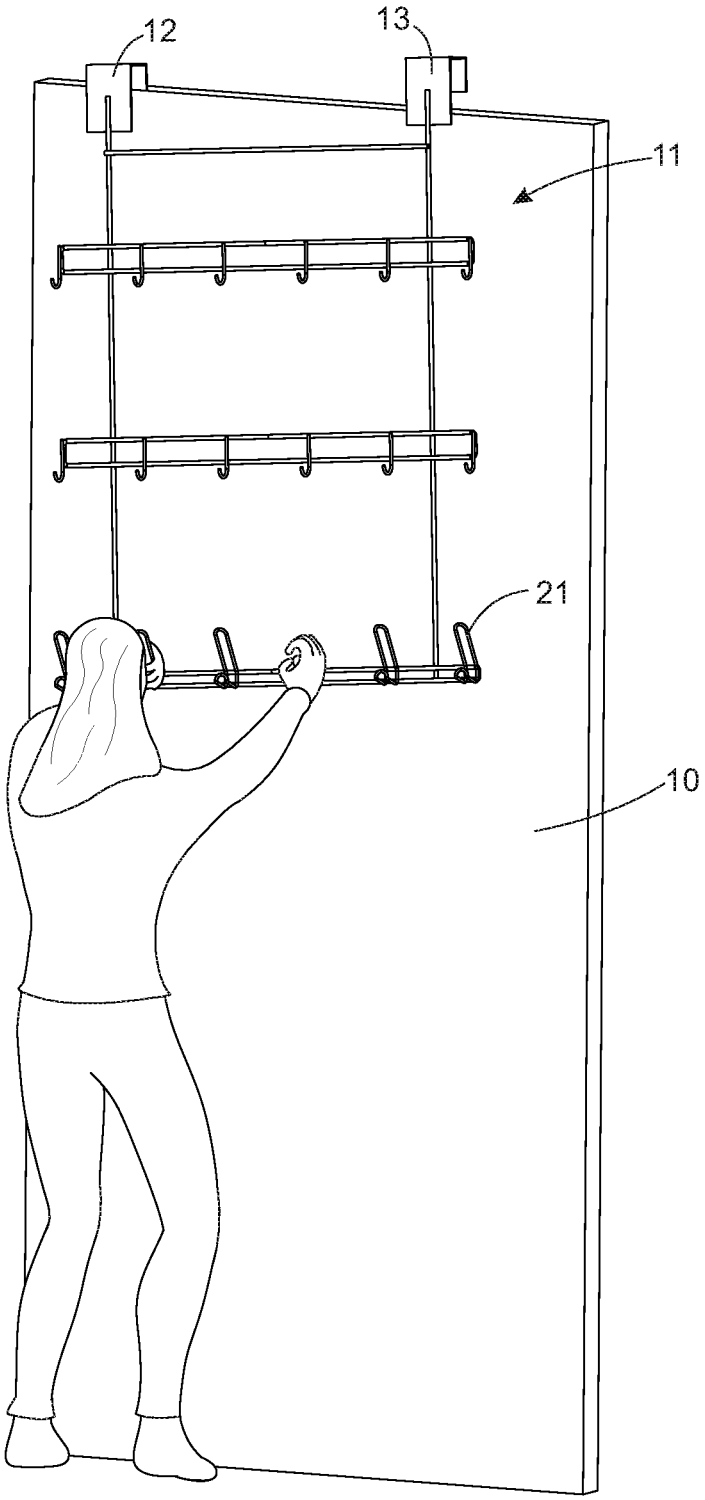
FIG. 11 is a perspective view of a user placing the over-the-door rack onto a door using the double hooks of the over-the-door rack according to one embodiment.

The continuous loop shape of double hook 21 providing a smooth hook with no sharp end points may be particularly advantageous for use as a handle when hanging the over-the-door rack 11 on a door 10. A user can lift the over-the-door rack 11 by grasping one or more of the double hooks 21 and lifting the over-the-door rack 11 such that the suspension hooks 12, and 13 can go over the top horizontal plane of the door 10, as shown in FIG. 11. This embodiment may be useful for children, persons with disabilities or other limitations, or persons having a height that is less than an average height because it allows installation of the over-the-door rack 11 without a user needing to be able to reach the top horizontal plane of a door 10 with the user's hands. The double hooks 21 may have rubberized grips, or may have one or more ridges to facilitate a user's ability to grip the double hooks 21 with the user's hands.

Figure 12:
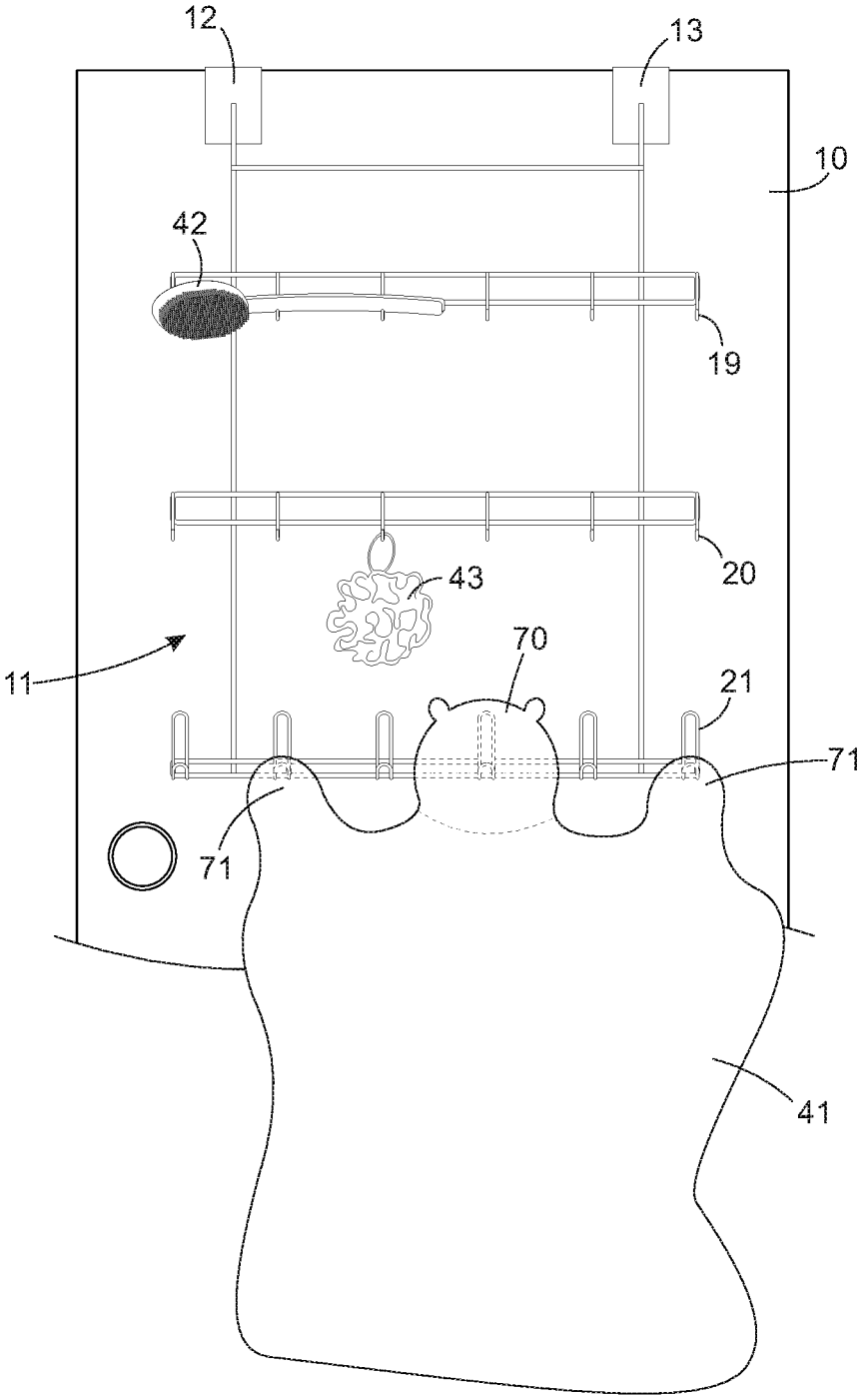
FIG. 12 is a front view of the over-the-door rack with a child's towel and other objects stored thereon.

Referring now to FIG. 12, an exemplary embodiment of the over-the-door rack 11 is shown with hanging member 28 being used to hang a child's towel 41. The child's towel 41 has a hood 70 and two hand covers 71. The child's towel can be spread out for more efficient and sanitary drying by placing the hood 70 on one of the rounded hooks 21 and spreading the hand covers 71 away from the hood 70 and hanging them on separate rounded hooks 21. A towel 40 that does not have a hood or hand covers could also be hung in this same manner. In that instance, a user may hang a towel 40 across multiple of the rounded hooks 21. A child's towel 41 or other towel 40 can be hung on the first hook portion 61 or second hook portion of the rounded hooks 21. For example, as shown in FIG. 12, the hood 70 of the child's towel 41 has been hung on the first end portion 63 of one of the rounded hooks 21, and the hand covers 71 have been hung on a second end portion 64. Hanging member 27 and hanging member 26 can also be used to hold other objects such as a scrubber 41, and a loofah 43.

Figure 13A:
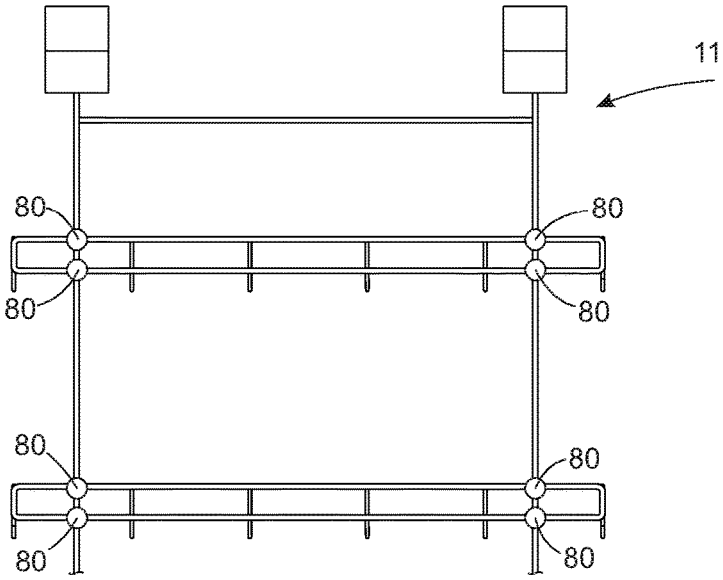
FIG. 13A is a partial back view of the over-the-door rack according to one embodiment in which the over-the-door rack has a plurality of bumpers disposed thereon.

Referring now to FIG. 13A, a partial view of the over-the-door rack 11 is shown. The over-the-towel rack 11 is shown comprising a plurality of bumpers 80 disposed on a back surface of the over-the-door rack 11. The back surface is the surface of the over-the-door rack 11 that abuts the surface of the door 10 when the over-the-door rack 11 is hanging on the door 10. The bumpers 80 may be made of any soft material, for example, felt, rubber, cloth, silicone, cardboard, cotton, and the like. The bumpers 80 may be disposed on the over-the-door rack 11 by glue, tape, adhesive, or by any other means. The bumpers 80 may further protect the surface of the door 10 from marring, marks, damage, chips, and dents otherwise caused by the over-the-door rack 11 coming into contact with the surface of the door 10. This may be especially so when a user slams the door 10 closed or open. The bumpers 80 may be disposed in any configuration on the over-the-door rack 11. The bumpers 80 are not limited to having a circular shape. For example, the bumpers 80 may be strips, squares, triangles, and the like.

Figure 13B:
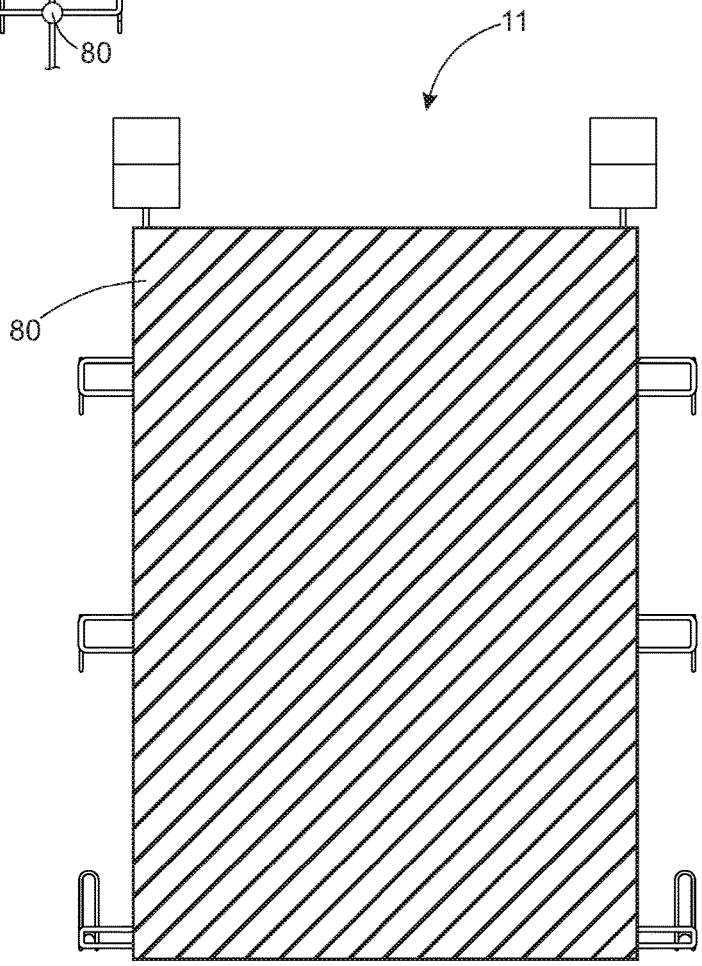
FIG. 13B is a back view of the over-the-door rack according to one embodiment in which the over-the-door rack has a single bumper.

The over-the-door rack 11 may have a single bumper 80 that is rectangular in shape and forms a backing that spans the back surface of the over-the-door rack 11, as shown in FIG. 13B. The bumper 80 may be made of a bacteria-resistant material, a waterproof material, a water-resistant material, or other material that has a softness sufficient to protect the surface of the door 10 from marking, scraping, scratching, chipping, denting, and the like caused by contact with the over-the-door rack 11.

Figure 14:
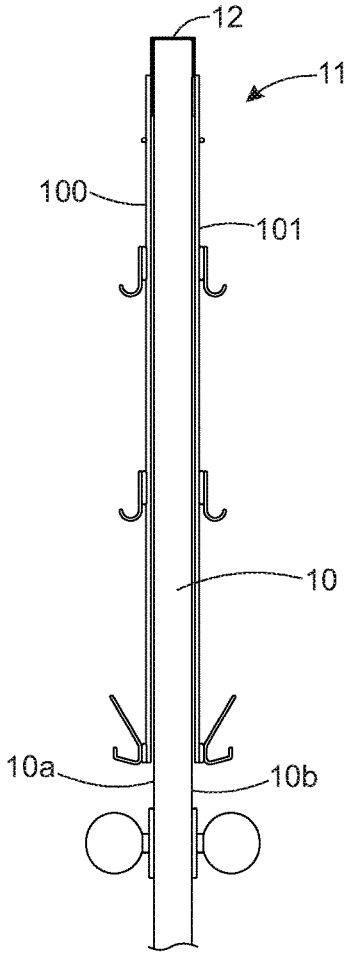
FIG. 14 is a side view of the over-the-door rack according to one embodiment in which the over-the-door rack is a double over-the-door rack having two sides.

Referring now to FIG. 14, another embodiment is shown in which the over-the-door rack 11 is double sided. The door 10 is shown having a first face 10A and a second face 10B. A first side 100 of the over-the-door rack 11 hangs down the first face 10A. A second side 101 of the over-the-door rack 11 extends from the front portions 53 of the suspension hooks 12, 13 down the second face 10B of the door 10. The second side 101 may have two vertical members and hanging members having a plurality of hooks disposed thereon. The first side 100 and the second side 101 may extend parallel to one another down the door 10. In this embodiment, the first side 100 of the over-the-door rack 11 has the same configuration as the second side 101 of the over-the-door rack, though it should be understood that the over-the-door rack 11 is not limited to this configuration. For example, the first side 100 may have a configuration comprising three hanging members 26, 27, 28, and the second side 101 may have one hanging member. Any configuration of the first side 100 and second side 101 is contemplated. As another example, the first side 100 of the over-the-door rack 11 may have a single static length, and the second side 101 may have an adjustable length enabled by elastic cords as described above with respect to FIGS. 2A-2C. As an additional example, each of the first side 100 and the second side 101 may have different hooks, or the same hooks, for example, the first side 100 may have all rounded hooks 19, 20, and the second side 101 may have all double hooks 21. Further, the first side 100 may extend lower down the door 10 than the second side 101, or vice versa.

Figure 15:
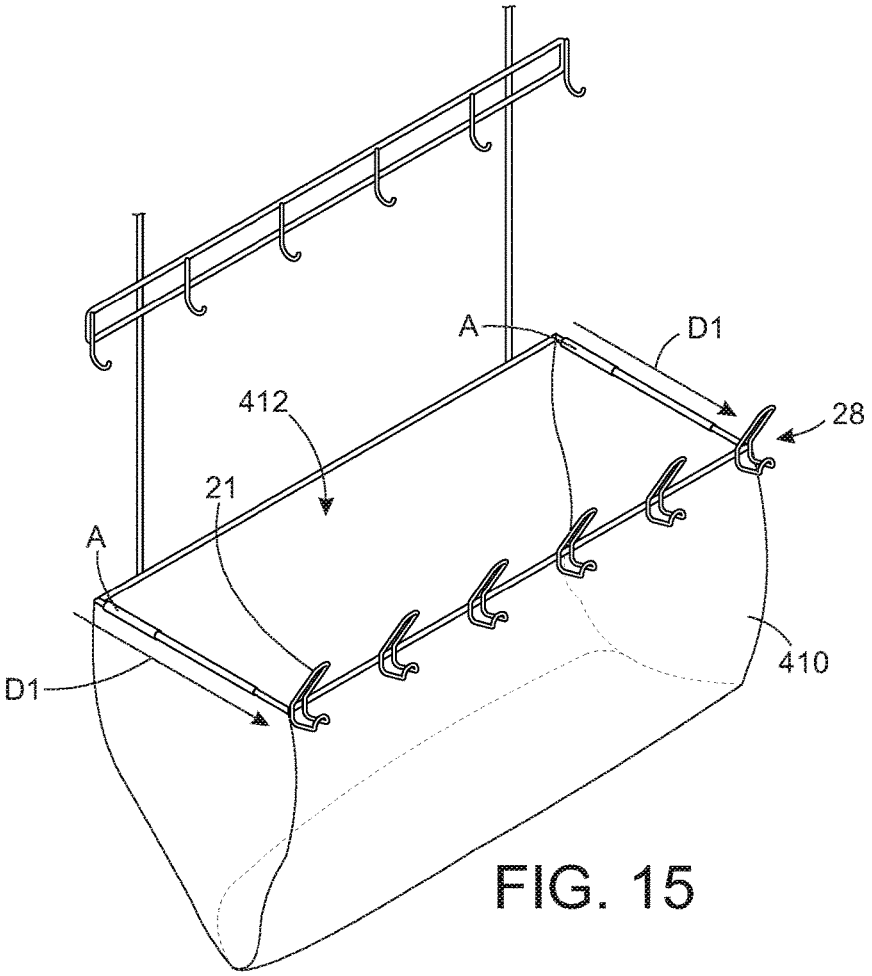
FIG. 15 is a perspective view of the over-the-door rack according to one embodiment in which a hanging member includes a flexible container.

Referring now to FIG. 15, hanging member 28 is shown with a plurality of double hooks 21. Hanging member 28 is shown having telescoping members A. Affixed to hanging member 28, including telescoping members A is a flexible container 410 having an opening 412. Flexible container 410 may be made of cloth, plastic, mesh, or other flexible material. In this embodiment, a user can extend hanging member 28 by pulling it in direction D1. The flexible container 410 is configured to extend with hanging member 28 such that the opening 412 is positioned such that objects can be received into opening 412 and into the flexible container 410. A user could store items used in the room in which the over-the-door rack 11 is used. In the case of a bathroom, a user, such as a child, could store the child's own toothpaste, bath toys, tooth brush, floss, or other items in the flexible container 410. To close the opening 412 of the flexible container 410, the child simply retracts the telescoping members A by pushing hanging member 28 opposite of direction D1. Items the child has hung on the double hooks 21 can remain in place when the child is using the flexible container 410. Flexible container 410 may further teach a child independence and responsibility by providing the child its very own place to store the items it uses in a room the most. As another example, if the over-the-door rack 11 is affixed to a child's bedroom door, a child may store a hairbrush, a glasses case, stationary materials the child uses in school, or other handy items in the flexible container 410, and the child may hang its jacket, a ball cap, or other garments on the double hooks 21. The flexible container 410 may also be configured to have multiple sections or compartments such that multiple children can store items in the flexible container 410, or such that a child can organize different categories of items for storage in the flexible container. Each hanging member 26, 27, and 28 may be configured to have a separate flexible container.

Figure 16C:
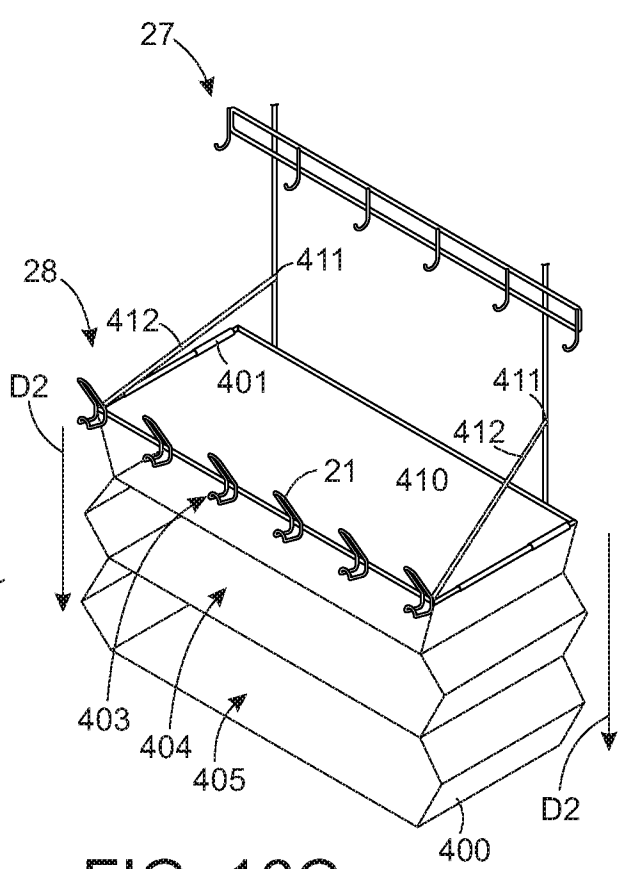
FIG. 16C is a perspective view of the over-the-door rack of 16C in which the extendable shelf structure has been extended.
Figure 16B:
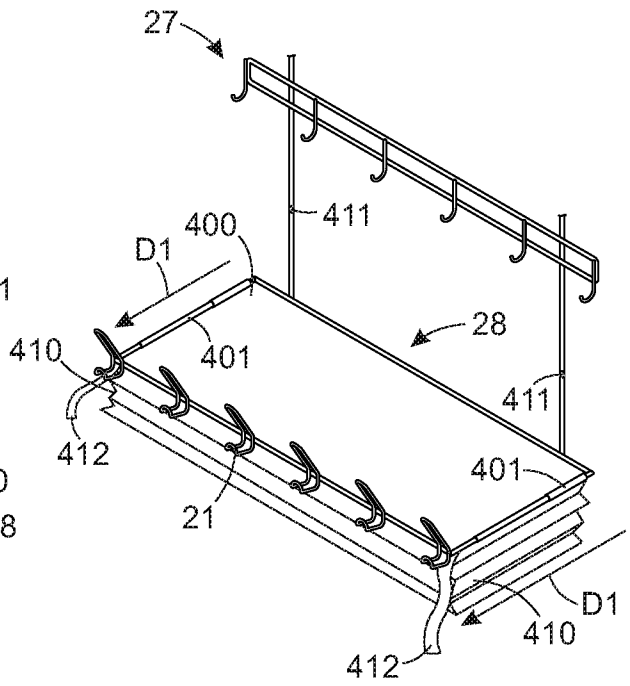
FIG. 16B is a perspective view of the over-the-door rack of FIG. 16A in which telescoping members of the over-the-door rack have been extended.
Figure 16A:
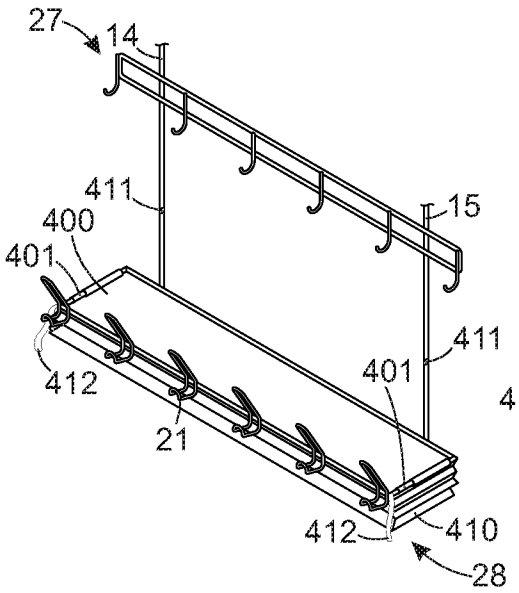
FIG. 16A is a perspective view of an over-the-door rack according to one embodiment in which a hanging member includes an extendable shelf structure.

Referring now to FIGS. 16A-16C, an embodiment of hanging member 28 is shown in which hanging member 28 comprises an extendable shelf structure 400. Shown in FIG. 16A, hanging member 28 has telescoping members 401. Attached to hanging member 28 is an extendable shelf structure 400 that has two retractably extendable walls 410. Vertical members 14 and 15 are shown each comprising an attachment mechanism 411. The extendable shelf structure is shown having two attachment strings 412. Shown in FIG. 16B, the telescoping members 401 have been extended by pulling hanging member in direction D1. Shown in FIG. 16C, the extendable shelf structure 400 is configured to extend downwards in direction D2 such that a plurality of shelves 403, 404, and 405 of the extendable shelf structure 400 open to receive items. The extendable shelf structure 400 is shown secured by attachment strings 412 attaching to attachment mechanisms 411. The attachment strings 412 may be attached to attachment mechanisms 411 by tying, hooking, sticking, or the like. For example, attachment mechanisms 412 may be buttons, hooks, protrusions with mushroom-shaped heads, and the like. When a child is learning the responsibility of hanging their own towel or garment on over-the-door rack 11, the child can also learn how to fold and put away their towel when it is dry. When the towel or garment is dry, the child can take it off of a double hook 21, fold the towel or garment, and place it into one of the shelves 403, 404, 405. The extendable walls 410 may extend by an accordion shape, or may extend and retract by a chain and a hook in which the extendable walls 410 could be retracted and secured in a retracted position by hooking a chain affixed to the extendable walls 410 to a hook disposed on telescoping members 401.

Figure 17A:
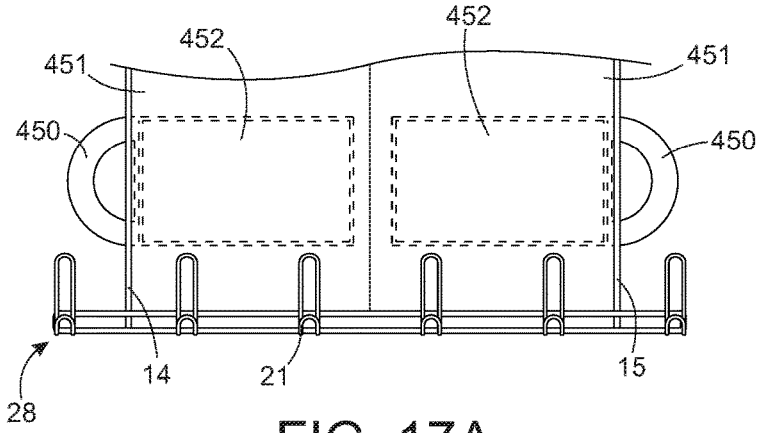
FIG. 17A is a front view of an over-the-door rack according to one embodiment in which the over-the-door rack includes extendable mirrors.
Figure 17B:
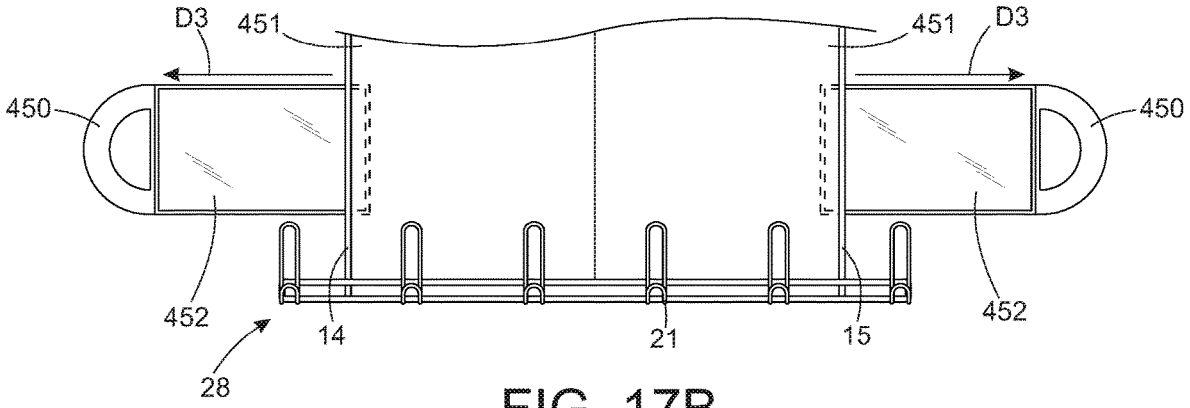
FIG. 17B is a front view of the over-the-door rack according to one embodiment in which the over-the-door rack includes extendable mirrors, in which the mirrors are in an extended position.
Figure 18A:
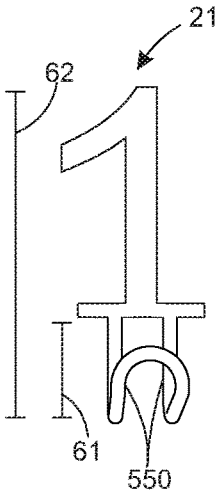
FIG. 18A is a perspective view of a double hook according to one embodiment in which the double hook has a number shape.
Figure 18B:
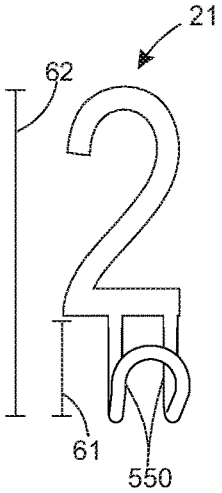
FIG. 18B is a perspective view of a double hook according to one embodiment in which the double hook has a number shape.
Figure 18C:
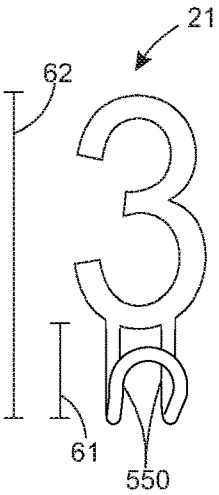
FIG. 18C is a perspective view of a double hook according to one embodiment in which the double hook has a number shape.
Figure 18D:
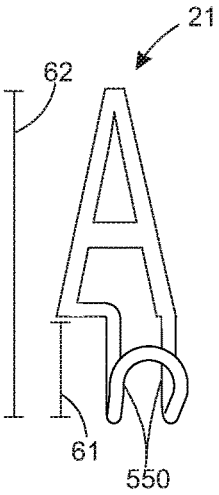
FIG. 18D is a perspective view of a double hook according to one embodiment in which the double hook has a letter shape.
Figure 18E:
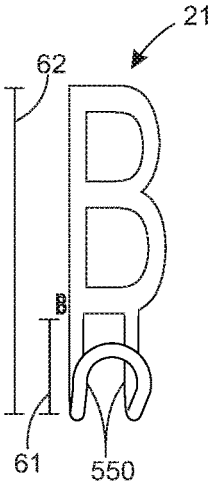
FIG. 18E is a perspective view of a double hook according to one embodiment in which the double hook has a letter shape.
Figure 18F:
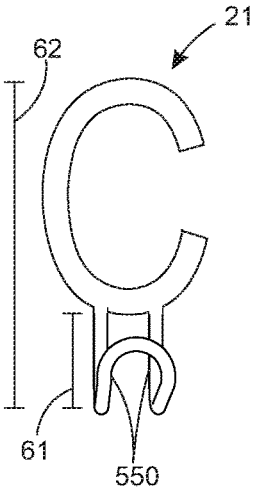
FIG. 18F is a perspective view of a double hook according to one embodiment in which the double hook has a letter shape.
Figure 18G:
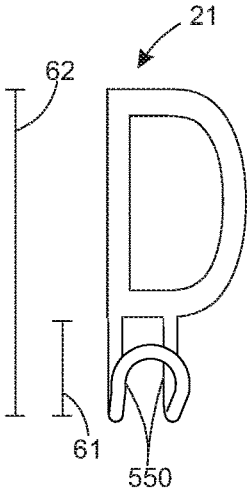
FIG. 18G is a perspective view of a double hook according to one embodiment in which the double hook has a letter shape.
Figure 18H:
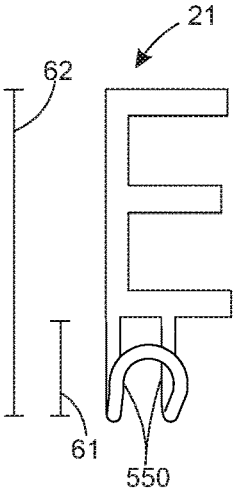
FIG. 18H is a perspective view of a double hook according to one embodiment in which the double hook has a letter shape.
Figure 19C:
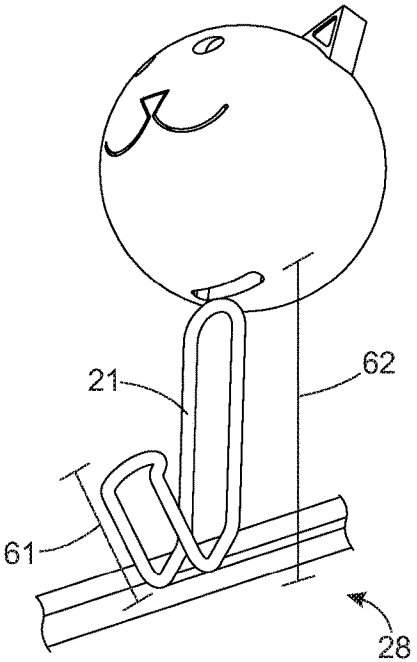
FIG. 19C is a perspective view of a character head positioned to engage with a double hook according to one embodiment.
Figure 19B:
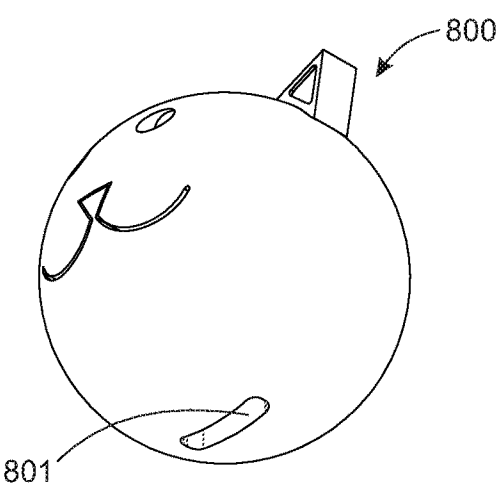
FIG. 19B is a bottom perspective view of a character head configured to engage with a double hook according to one embodiment.
Figure 19A:
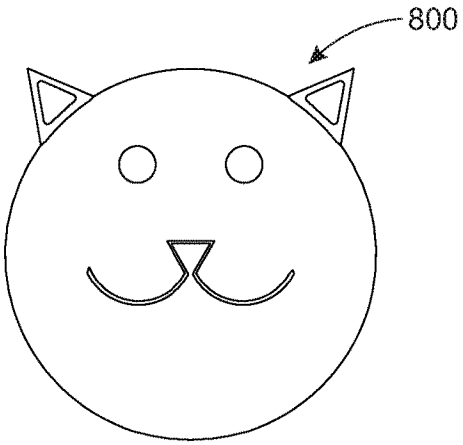
FIG. 19A is a front view of a character head configured to engage with a double hook according to one embodiment.
Figure 19D:
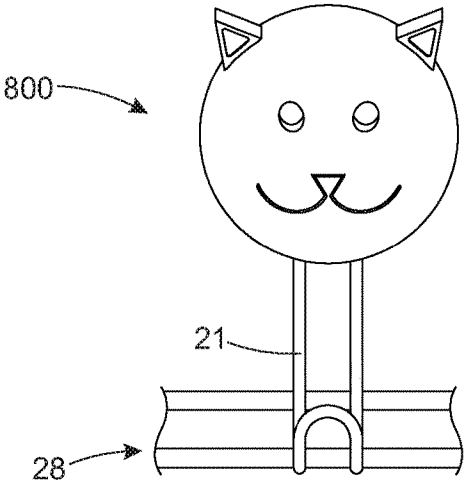
FIG. 19D is a front view of a character head having been placed on a double hook according to one embodiment.

In another embodiment shown in FIGS. 17A and 17B, the over-the-door rack 11 may comprise one or more pockets 451 extending between vertical members 14, and 15, out of which one or more mirrors 452 can extend. The mirrors 452 shown in FIGS. 17A and 17B may have handles 450 that a child could grasp to pull one of the mirrors 452 out for use. A child may use their own mirror 452 to brush their teeth, brush their hair, floss, or other activity. Often times, many people in a household need a mirror to get ready for school or work, but there is only one mirror in a bathroom. The mirrors 452 on the over-the-door rack 11 provide a location for a child to get ready that is their own, allowing other individuals in a home to use other mirrors in the house. This enables efficiency in getting ready for busy families, while making the over-the-door rack 11 more child-friendly. For a child, seeing themself in a mirror 452 may also instill a sense of pride and ownership regarding the over-the-door rack 11, making children more excited to use the over-the-door rack 11 and learn responsibility and self-care. The over-the-door rack 11 could have a single pocket 451 with a single mirror 452. As another example, the over-the-door rack could have a pocket above each hanging member 26, 27, and 28 for children of different ages to use.

The over-the-door rack 11 may comprise additional child-friendly responsibility tools, for example, a reward chart may hang from the over-the-door rack 11, or the over-the-door rack 11 may comprise a bell or other auditory device that the child can ring or sound when they have accomplished the task of hanging up their towel or garment on the over-the-door rack 11. A reward chart could be configured to be written on to keep track of the number of times a child has hung up their towel or garment, to assign hanging duties to certain children, or the like. A reward chart could be magnetic and have magnets to keep track of a child's towel responsibilities.

Referring now to FIGS. 18A-H, the double hooks 21 are not limited to the shape shown in FIG. 10, and are further not limited to being permanently disposed on hanging member 28. Referring now to FIG. 18, a plurality of double hooks 21 is shown each having a different educational shape, including numbers and letters. The alphabet and number shapes can be achieved while preserving a continuous loop of material and the smoothness resulting therefrom. As shown in FIGS. 18A-H, each double hook 21 has a first hook portion 61 and a second hook portion 62, and no matter what shape, letter or number a double hook 21 takes, there are multiple attachment points on which a child could hang a towel, garment, or other item. Further, each double hook 21 shown in FIG. 18 comprises multiple attachment points 550 on the back of each double hook (not shown), for example the attachment points 550 may protrusions like the protrusions 301 shown in FIG. 3A. In one embodiment, hanging member 28 may have a plurality of holes, slits, adhesive points, or other attachment mechanisms with which the attachment points 550 can engage to secure the double hooks 21 to hanging member 28. In this embodiment, a child can assist an adult or caregiver in assembly of the over-the-door rack by choosing the positioning of the double hooks 21. Using the educational shapes shown in FIG. 18S A-H, a child can learn the alphabet or numbers by placing the double hooks 21 in the correct alphabetical or numerical order from left to right on hanging member 28, or the child could use the correct double hooks 21 needed to spell their own name by placing the double hooks 21 shaped like letters in the correct order from left to right on hanging member 28. It is contemplated that double hooks 21 could be shaped into any number, letter, or symbol, and are not limited to being shaped into Arabic numerals or English letters, and could be any language letters and numbers.

Referring now to FIGS. 19A-19D, character head 800 is shown comprising a double hook slot 801. The double hook slot 801 is configured to receive the second hook portion 62 of a double hook 21. Often times, children are more receptive to learning and taking on responsibility when their favorite characters from books, movies, television, or comics are a part of the task to be learned. Accordingly, character heads 800 can be used to make double hooks 21 more child-friendly. Character head 800 is shown shaped like a cat head, but it should be understood that character head 800 could be shaped like any head, such as any animal, movie characters, book characters, and the like, for example, Mickey Mouse®. Character head 800 may be configured to comprise a clamping mechanism that a child could use to clamp onto their towel or garment to help spread out their towel or garment among different double hooks 21 to make the drying process quicker and more sanitary. The clamping mechanism could have an amusing placement, for example, the clamping mechanism could be configured such that when a child squeezes the character head 800, the character head's 800 mouth opens and when the child releases the character head 800, the mouth of the character head 800 closes to make the character head 800 appear to be biting or eating the child's towel or garment. The character head 800 can also be used to designate ownership of a particular double hook. For example, a family with multiple children could teach each child the responsibility of hanging their towel or garment all by themselves by giving each child a different character head 800 and having the child pick their own double hook 21. Each child could place their individual character head 800 on a different double hook 21 so each child knows which double hook 21 is theirs to use. A character head 800 may be made out of a water-resistant or waterproof material such as plastic or rubber. A character head 800 may also be used as a bath toy, which may make a child more excited about hanging up their own towel or garment after a bath or shower, because the child can play with the character head 800, and then store the character head 800 on a double hook 21 and hang their towel or garment over the character head 800 or use a clamping mechanism of the character head 800. In this manner, the character head 800 forms a holistically positive experience for the child that will keep them interested in taking on more responsibility.

Figure 20:
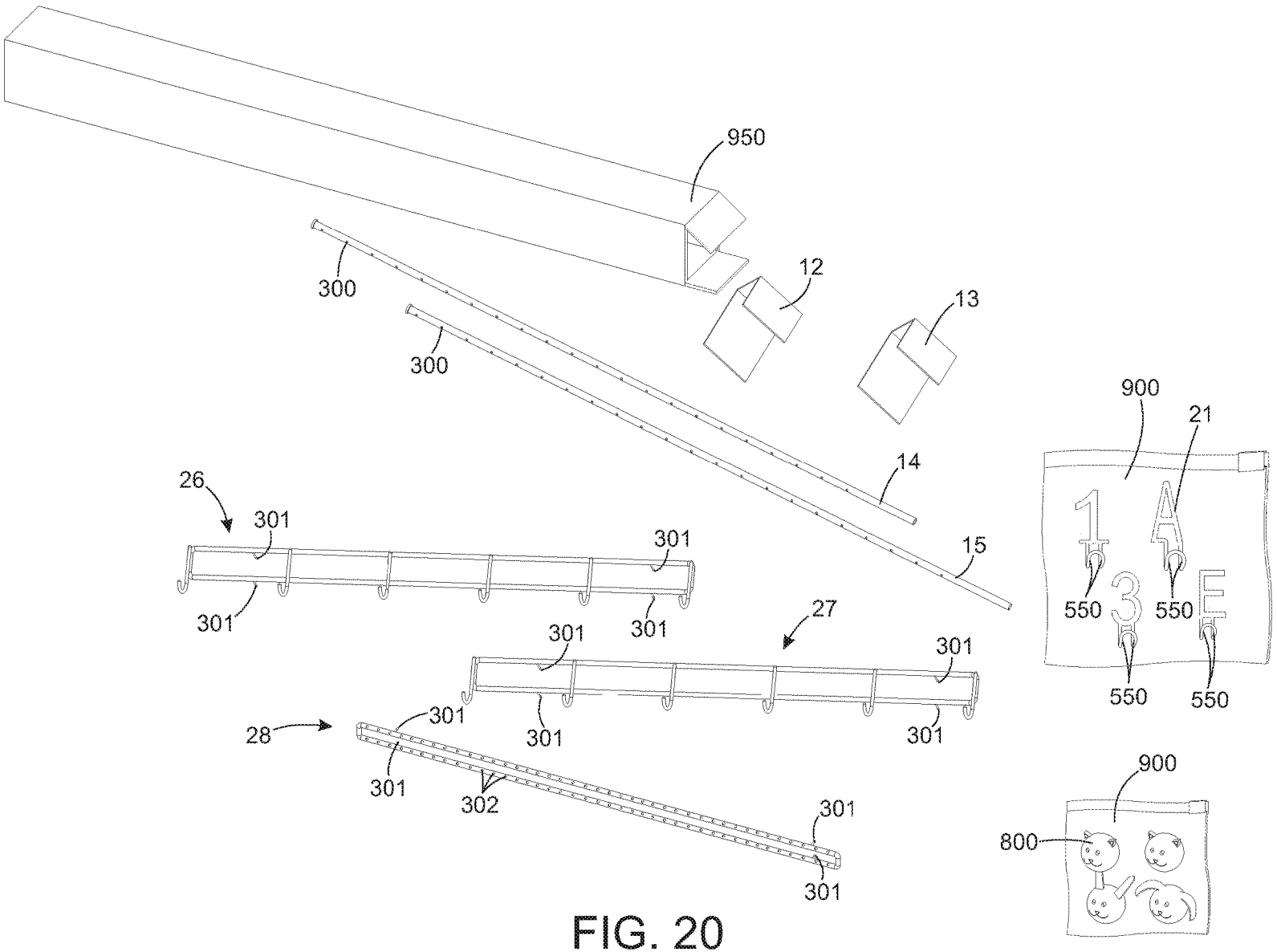
FIG. 20 is a perspective view of an over-the-door rack kit.

Referring now to FIG. 20, the over-the-door rack 11 may come to the user as a kit of components that can be assembled into over-the-door rack 11. In one embodiment shown in FIG. 20, an over-the-door rack 11 kit may comprise first vertical member 14 and second vertical member 15 each having a plurality of holes 300, first suspension hook 12 and second suspension hook 13, hanging member 26 having rounded hooks 19, hanging member 27 having rounded hooks 20, and hanging member 28 a plurality of holes 302 configured to receive attachment mechanisms 550 of the double hooks 21. Each hanging member 26, 27, and 28 may have protrusion 301 that can engage with the plurality of holes 300 on first vertical member 14 and second vertical member 15. The over-the-door rack 11 kit is also shown including double hooks 21 each having a different letter shape. The over-the-door rack 11 kit also comprises a second container 901 containing a plurality of different character heads 800 having double hook slots 801. The double hooks 21 and character heads 800 may come in plastic containers 900. The over-the-door rack 11 kit is not limited to including the embodiments or parts shown in FIG. 20, and could include any of the embodiments or parts described herein, and any combinations thereof. The over-the-door rack 11 kit may come in a container such as a box 950. This embodiment may be advantageous because it permits the over-the-door rack 11 to be purchased in a form that takes up less space than an assembled over-the-door rack. This embodiment also enables a user to put together the over-the-door rack in a configuration that suits their individual needs.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An over-the-door rack comprising:

a first suspension hook configured to be placed over a top horizontal plane of a door such that the first suspension hook is configured to rest on the top horizontal plane of the door;

a second suspension hook configured to be placed over the top horizontal plane of [a] the door such that the second suspension hook is configured to rest on the top horizontal plane of the door;

a first vertical member operatively attached to the first suspension hook;

a second vertical member operatively attached the second suspension hook;

a first hanging member operatively attached to the first vertical member and the second vertical member such that the first hanging member defines a bottom edge of the over-the-door rack;

wherein the first hanging member comprises a plurality of double hooks, wherein each double hook of the plurality of double hooks comprises a continuous ring of rigid material curved into a first hook portion and a second hook portion; wherein the first hook portion has a first length, wherein the second hook portion has a second length, and wherein the first length and the second length are different;

wherein each double hook of the plurality of double hooks further comprises more than one attachment point;

a second hanging member is operatively attached to the first vertical member and the second vertical member;

wherein the second hanging member comprises a plurality of hooks, wherein each hook of the plurality of hooks has an end extending away from the second hanging member such that the end forms a single attachment point and is configured to extend upwardly;

wherein the over-the-door rack is configured to be affixed to the door such that the over-the-door rack extends away from the top horizontal plane of a door and such that the first hanging member is positioned lower than a middle of a vertical length of the door, wherein the vertical length of the door extends from the top horizontal plane to a bottom horizontal plane of the door.

2. The over-the-door rack of claim 1, wherein the first suspension hook and the second suspension hook are each enclosed in a rubber coating.

3. The over-the-door rack of claim 1, wherein the first hanging member and the second hanging member each further comprise a water-resistant name sleeve.

4. The over-the-door rack of claim 1, further comprising at least one bumper affixed to a back surface of the over-the-door rack.

5. The over-the-door rack of claim 1, wherein the first vertical member comprises a first plurality of holes and wherein the second vertical member comprises a second plurality of holes;

wherein each of the first hanging member and the second hanging member further comprises at least one protrusion configured to be releaseably pressed into one of the first plurality of holes and the second plurality of holes such that the first hanging member and second hanging member are releaseably secured onto the over-the-door rack.

6. The over-the-door rack of claim 1 further comprising a third vertical member operatively connected to the first suspension hook and a fourth vertical member operatively connected to the second suspension hook;

a third hanging member operatively connected to the third vertical member and the fourth vertical member;

wherein the third hanging member comprises at least one of a double hook comprising a continuous ring of rigid material curved into a first hook portion and a second hook portion; wherein the first hook portion has a first length, wherein the second hook portion has a second length, and wherein the first length and the second length are different;

a hook having a single attachment point; and a combination thereof;

wherein the over-the-door rack is configured to hang on a door such that the first vertical member and the second vertical member are configured to extend down a first face of the door, and such that the third vertical member and the fourth vertical member are configured to extend down a second face of the door parallel to the first vertical member and the second vertical member.

7. The over-the-door rack of claim 1, wherein the first vertical member comprises a first opening extending a first entire length of the first vertical member; wherein the second vertical member comprises a second opening extending a second entire length of the second vertical member;

wherein the over-the-door rack further comprises a first extendable member operatively attached to the first suspension hook and inserted through the first opening of the first vertical member; and a second extendable member operatively attached to the second suspension hook and inserted through the second opening of the second vertical member;

wherein the first extendable member is configured to secure the first vertical member along the first extendable member;

wherein the second extendable member is configured to secure the second vertical member along the second extendable member;

wherein the over-the-door rack is configured to be releaseably extended down a length of the door by pulling the over-the-door rack down.

8. The over-the-door rack of claim 7 wherein each of the first extendable member and the second extendable member is spring loaded.

9. The over-the-door rack of claim 7, wherein each of the first extendable member and the second extendable member is configured to extend and retract by telescoping.

10. The over-the-door rack of claim 1, wherein each double hook of the plurality of double hooks is configured to receive a character head thereon.

11. The over-the-door rack of claim 1, wherein each double hook of the plurality of double hooks is releaseably attachable to the first hanging member.

12. The over-the-door rack of claim 11, wherein each double hook of the plurality of double hooks is configured to be shaped like a different letter of the alphabet.

13. The over-the-door rack of claim 1 wherein the first hanging member is extendable a first distance from and perpendicular to the door; wherein the second hanging member is extendable a second distance from and perpendicular to the door.

14. The over-the-door rack of claim 13 wherein the first hanging member further comprises a first flexible container that is configured to open when the first hanging member is extended, such that the first flexible container is able to receive objects; and wherein the second hanging member further comprises a second flexible container that is configured to open when the second hanging member is extended, such that the second flexible container is able to receive objects.

15. The over-the-door rack of claim 13 wherein the first hanging member further comprises an extendable shelf structure comprising a plurality of shelves;

wherein the extendable shelf structure is configured to extend away from the over-the-door rack when the first hanging member is extended;

wherein the extendable shelf structure is configured to extend downwards such that the plurality of shelves open to receive items.

16. The over-the-door rack of claim 1, wherein the second hanging member comprises a shelf having a first shelf end and a second shelf end each located along the second hanging member, and a shelf body extending between the first shelf end and second shelf end, wherein the shelf body has a curved shape extending between the first shelf end and second shelf end.

17. The over-the-door rack of claim 1, wherein the over-the-door rack further comprises a strap configured to extend around the door, wherein the strap comprises a clasp, and wherein the strap is configured to secure the over-the-door rack to the door by the clasp.

18. The over-the-door rack of claim 1, wherein each of the first suspension hook and the second suspension hook comprises a releasable clamp, wherein each releasable clamp has a front portion and a back portion configured to be releasably separated into an open position from a default closed position.

19. An over-the-door rack kit comprising:

a first suspension hook configured to be placed over a top horizontal plane of a door such that the first suspension hook is configured to rest on the top horizontal plane of the door;

a second suspension hook configured to be placed over the top horizontal plane of the door such that the second suspension hook is configured to rest on the top horizontal plane of the door;

a first vertical member configured to operatively attach to the first suspension hook;

a second vertical member configured to operatively attach to the second suspension hook;

a first hanging member configured to operatively attached to the first vertical member and the second vertical member such that the first hanging member defines a bottom edge of the over-the-door rack;

a plurality of double hooks, wherein each double hook of the plurality of double hooks comprises a continuous ring of rigid material curved into a first hook portion and a second hook portion; wherein the first hook portion has a first length, wherein the second hook portion has a second length, and wherein the first length and the second length are different; wherein each double hook of the plurality of hooks is configured to releaseably attach to the first hanging member;

wherein each double hook of the plurality of double hooks further comprises more than one attachment point;

a second hanging member is configured to operatively attach to the first vertical member and the second vertical member;

a plurality of hooks configured to releaseably attach to the second hanging member; wherein each hook of the plurality of hooks has an end configured to extend away from the second hanging member such that the end forms a single attachment point and is configured to extend upwardly;

wherein the over-the-door rack is configured to be assembled such that the over-the-door rack is configured to be affixed to the door such that the over-the-door rack extends away from the top horizontal plane of the door and such that the first hanging member is positioned lower than a middle of a vertical length of the door, wherein the vertical length of the door extends from the top horizontal plane to a bottom horizontal plane of the door.

20. The over-the-door kit of claim 19, wherein the first vertical member comprises a first opening extending a first entire length of the first vertical member; wherein the second vertical member comprises a second opening extending a second entire length of the second vertical member;

wherein the over-the-door kit further comprises a first extendable cord configured to operatively attach to the first suspension hook and configured to be inserted through the first opening of the first vertical member; and a second extendable cord configured to operatively attach to the second suspension hook and configured to be inserted through the second opening of the second vertical member;

wherein the first extendable cord is configured to secure the first vertical member along the first extendable cord such that the first extendable cord does not exit the first opening of the first vertical member;

wherein the second extendable cord is configured to secure the second vertical member along the second extendable cord such that the second extendable cord does not exit the second opening of the second vertical member;

wherein the over-the-door rack is configured to be releaseably extended down a length of the door by pulling the over-the-door rack down, when the over-the-door rack is assembled.

21. An over-the-door rack comprising:

a first suspension hook configured to be placed over a top horizontal plane of a door such that the first suspension hook is configured to rest on the top horizontal plane of the door;

a second suspension hook configured to be placed over the top horizontal plane of the door such that the second suspension hook is configured to rest on the top horizontal plane of the door;

a first vertical member operatively attached to the first suspension hook;

a second vertical member operatively attached the second suspension hook;

a first hanging member operatively attached to the first vertical member and the second vertical member such that the first hanging member defines a bottom edge of the over-the-door rack;

wherein the first hanging member comprises a plurality of double hooks, wherein each double hook of the plurality of double hooks comprises a continuous ring of rigid material curved into a first hook portion and a second hook portion; wherein the first hook portion has a first length, wherein the second hook portion has a second length, and wherein the first length and the second length are different;

wherein each double hook of the plurality of double hooks further comprises more than one attachment point;

a second hanging member is operatively attached to the first vertical member and the second vertical member; wherein the second hanging member comprises a plurality of hooks, wherein each hook of the plurality of hooks has a single attachment point;

wherein the over-the-door rack is configured to be affixed to the door such that the over-the-door rack extends away from the top horizontal plane of a door and such that the first hanging member is positioned lower than a middle of a vertical length of the door, wherein the vertical length of the door extends from the top horizontal plane to a bottom horizontal plane of the door;

wherein the first vertical member comprises a first plurality of holes and wherein the second vertical member comprises a second plurality of holes;

wherein each of the first hanging member and the second hanging member further comprises at least one protrusion configured to be releaseably pressed into one of the first plurality of holes and the second plurality of holes such that the first hanging member and second hanging member are releaseably secured onto the over-the-door rack.

* * * * *